US007396101B2

(12) United States Patent
Watarai

(10) Patent No.: US 7,396,101 B2
(45) Date of Patent: Jul. 8, 2008

(54) INKJET RECORDING DEVICE WITH CONTACT-AREA DETECTION UNIT

(75) Inventor: Katsuya Watarai, Ena (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 218 days.

(21) Appl. No.: 11/034,070

(22) Filed: Jan. 13, 2005

(65) Prior Publication Data

US 2005/0151773 A1 Jul. 14, 2005

(30) Foreign Application Priority Data

Jan. 14, 2004 (JP) ..... 2004-006996

(51) Int. Cl.
*B41J 29/393* (2006.01)
*B41J 25/308* (2006.01)
*B65H 7/02* (2006.01)

(52) U.S. Cl. ..... 347/19; 347/8; 271/258.01

(58) Field of Classification Search ..... 347/16
See application file for complete search history.

(56) References Cited

U.S. PATENT DOCUMENTS 4,155,544 A * 5/1979 Scott ..... 271/8.1
6,095,628 A * 8/2000 Rhome ..... 347/4
6,908,190 B2 * 6/2005 Iwatsuki et al. ..... 347/104
7,021,622 B2 * 4/2006 Carter et al. ..... 271/258.01
2003/0197750 A1 10/2003 Iwatsuki et al. ..... 347/104
2004/0233244 A1 * 11/2004 Elgee et al. ..... 347/19
2006/0071391 A1 * 4/2006 Chelvayohan et al. ... 271/10.01

FOREIGN PATENT DOCUMENTS

JP A 11-179934 7/1999
JP A 2001-262459 9/2001
JP A 2003-311938 11/2003

* cited by examiner

*Primary Examiner*—Matthew Luu
*Assistant Examiner*—Shelby Fidler
(74) *Attorney, Agent, or Firm*—Oliff & Berridge, PLC

(57) ABSTRACT

An inkjet recording device, capable of reliably detecting obstacles such as wrinkles or foreign particles on a recording medium, is provided with a clearance sensor mechanism for detecting foreign particles and wrinkles on the recording medium. In such an inkjet recording device, printing is performed by scanning with the inkjet head while a platen on which the recording medium is mounted is fed. When a plate-like member provided between the default position in which the platen is on standby and the printing performing position to be scanned by the inkjet head contacts foreign particles or wrinkles of the recording medium mounted on the platen, the concealing member, together with the plate-like member, rotates about the axis line direction of an axis member. When a sensor detects the rotation of the concealing member, the platen is fed in the reverse direction. Further, when the inkjet head starts printing, a solenoid presses a receiving member and rotates the plate-like member.

14 Claims, 16 Drawing Sheets

INKJET RECORDING DEVICE WITH CONTACT-AREA DETECTION UNIT

BACKGROUND OF THE INVENTION

1. Field of the Invention

The present invention relates to an inkjet recording device, and in particular relates to an inkjet recording device capable of detecting obstacles such as wrinkles and foreign particles on a recording medium.

2. Description of the Related Art

Conventionally, with an inkjet recording device which performs recording by ejecting ink to a recording medium, after printing paper or the like, which is the recording medium, is mounted on a platen, a feed mechanism for feeding the platen feeds such printing paper to the position of an inkjet head. Then, inks are guided from an ink supply source to a plurality of ejection channels of the inkjet head, an actuator such as a heater element or piezoelectric element is selectively driven, and inks are ejected from the nozzle face provided to the tip of the ejection channel to the printing paper or the like. After the recording to the printing paper or the like is completed, the printing paper subjected to recording is returned to the original standby position of the platen before the start of recording.

With this kind of inkjet recording device, when obstacles such as a foreign particle or dust are adhered to the recording medium mounted on the platen, it is known that adverse effects are exerted on the recording results to the recording medium such as the ejection of ink to an accurate position being hindered, or the ink being ejected on such foreign particle or dust and therefore not being attached directly on the recording medium. Further, when these obstacles contact the nozzle face of the inkjet head as a result of the platen being fed, there is a problem in that an adverse effect is exerted on the subsequent printing as a result of the nozzle face being damaged or tainted.

Thus, conventionally, an optical sensor for detecting obstacles such as a foreign particle or dust has been provided to the inkjet recording device. For instance, as the inkjet recording device having such an optical sensor, known is an inkjet recording device in which a printing head in which a plurality of nozzles are disposed serially is passed through above an optical beam, and, when a foreign particle is adhered to the printing head, since the intensity of the optical signal detected with the optical sensor will weaken, the foreign particle adhered to the lower face of the printing head can be detected (for example, c.f. Japanese Patent Application Laid-Open No. H11-179934).

Further, with this kind of inkjet recording device, although it is common practice to perform recording on paper or the like as the recording medium, also known is an inkjet printer for fabrics wherein recording is performed on fabrics such as a T-shirt. With this kind of inkjet printer for fabric, in addition to the problem of the adhesion of obstacles such as foreign particles and dust, there is a problem in that an adverse effect is exerted on the recording results or the nozzle face since the fabric itself, which is the recording medium, easily floats and wrinkles, and the floating and wrinkling of such fabric will become an obstacle.

Thus, known is an inkjet printing device in which a sensor for measuring the distance to the fabric, which is the recording medium, is provided to the side that is more upstream than the printer head at the lower part of the carriage, whereby this sensor continuously measures clearances between the sensor and the fabric surface, and, when the sensor detects clearances of a certain value or less, this detection result is interpreted to indicate a wrinkle, and this is notified to the operator, or the feeding is automatically stopped (for example, c.f. Japanese Patent Application Laid-Open No. 2001-262459).

Nevertheless, with the method of detecting obstacles such as a foreign particle or dust in the inkjet recording device with an optical sensor, depending on the various conditions such as the reflection of the optical beam, there are cases where an obstacle is erroneously detected, or the obstacle cannot be detected, and there is a problem in that the inkjet recording device will malfunction in such a case. Although it is considered to technically advance the optical sensor to deal with the foregoing situation, there is a problem in that the installation of a more accurate optical sensor in an inkjet recording device will cause increased costs.

Moreover, even with the invention described in Japanese Patent Application Laid-Open No. 2001-262459, since it employs an optical sensor to measure the clearance between the sensor and the fabric surface, it encounters the same problem as with the conventional method described above.

Meanwhile, after the recording to the recording medium is completed, with an inkjet recording device which feeds the platen to a standby position of the platen before the start of recording, there is a problem in that the recording medium subjected to recording and mounted on the platen contacts the optical sensor upon passing though immediately beneath the optical sensor due to the thickness of the ejected ink or the floating or wrinkling that occurs upon feeding. In particular, when the recording medium contacts the optical sensor in a state in which the ejected ink is not yet completely dried, the optical sensor will become tainted with the ink ejected on the recording medium, and there is a problem in that the precision of the optical sensor will deteriorate. Meanwhile, also with the recording medium subjected to recording, there is a problem in that the ink would smear or taint the recording medium or the optical sensor as a result of contacting the optical sensor. Further, there is also a possibility that the contact of the optical sensor and recording medium would damage each other.

SUMMARY OF THE INVENTION

The present invention was devised to overcome the foregoing problems, and an object thereof is to provide an inkjet recording device capable of reliably detecting obstacles such as wrinkles or foreign particles in a recording medium and of being manufacturing a recording medium easily and inexpensively. Another object of the present invention is to provide an inkjet recording device capable of preventing the recording medium subjected to recording from contacting a detection unit such as a sensor, and preventing the recording medium and sensor from becoming tainted or damaged.

In order to achieve the foregoing objects, the present invention provides an inkjet recording device (as a first mode) which comprises:

a recording unit equipped with a nozzle face for performing recording by ejecting ink to a recording medium;

a platen disposed facing the nozzle face for supporting the recording medium at a prescribed spacing from the nozzle face;

a feed mechanism for feeding the platen to a position where recording is to be performed with the recording unit, in which the recording unit records on the recording medium while the feed mechanism feeds the platen, and, after the recording is completed, the feed mechanism feeds the platen to the standby position of the platen prior to the start of recording;

a detection unit provided so as to be capable of facing the platen between the standby position and the recording unit, and for detecting the contact area where the recording medium supported by the platen contacts the nozzle face at a detection position on the platen side rather than the nozzle face side of the recording unit; and a feed mechanism control unit for controlling the feed mechanism to stop feeding the platen or to feed the platen to the standby position when the detection unit detects the contact area.

Further, the inkjet recording device of the present invention preferably further comprises a detection unit withdrawal unit for withdrawing the detection unit to a position at which said detection unit does not contact the recording medium after the recording is completed.

Moreover, in the inkjet recording device of the present invention, the detection unit withdrawal unit preferably withdraws the detection unit to a position at which said detection unit is at least 5 mm apart from the recording medium after the recording is completed.

Further, in the inkjet recording device of the present invention, the detection unit withdrawal unit preferably withdraws the detection unit to a position at which said detection unit is placed higher than the nozzle surface with respect to the platen when the detection unit does not detect the contact area or when the recording unit performs recording.

Moreover, in the inkjet recording device of the present invention, the detection unit is preferably supported rotatably about the axis line orthogonal to the direction in which the platen is fed, has a plate-like member capable of contacting the contact area, a concealing member provided integrally with the plate-like member for determining whether or not the contact area was detected, and a sensor unit for detecting the concealing member, wherein, when the recording medium contacts the plate-like member while the platen is being fed, the concealing member rotates about the axis line; and when the sensor unit transits from a detection state to a non-detection state or transits from a non-detection state to a detection state for the concealing member, the feed mechanism control unit controls the feed mechanism to stop feeding the platen or to feed the platen to the standby position.

Further, in the inkjet recording device of the present invention, the detection unit withdrawal unit preferably rotates and withdraws the detection unit.

Moreover, in the inkjet recording device of the present invention, the detection unit withdrawal unit is preferably an actuator which is provided in the vicinity of the detection unit and which presses and rotates the detection unit.

Further, in the inkjet recording device of the present invention, the recording medium is preferably fabric.

Moreover, the present invention also provides an inkjet recording device (as a second mode) which comprises:

a recording unit equipped with a nozzle face for performing recording by ejecting ink to a recording medium;

a platen disposed facing the nozzle face for supporting the recording medium at a prescribed spacing from the nozzle face;

a feed mechanism for feeding the platen to a position where recording is to be performed with the recording unit, in which the recording unit records on the recording medium while the feed mechanism feeds the platen, and, after the recording is completed, the feed mechanism feeds the platen to the standby position of the platen prior to the start of recording;

a detection unit for detecting the contact area where the recording medium supported by the platen contacts the nozzle face;

a feed mechanism control unit for controlling the feed mechanism to stop feeding the platen or to feed the platen to the standby position when the detection unit detects the contact area; and a detection unit withdrawal unit for withdrawing the detection unit to a position at which said detection unit does not contact the recording medium after the recording is completed.

Further, in this inkjet recording device of the present invention, the detection unit withdrawal unit also preferably withdraws the detection unit to a position at which said detection unit is at least 5 mm apart from the recording medium after the recording is completed.

Moreover, in this inkjet recording device of the present invention, the detection unit withdrawal unit also preferably withdraws the detection unit when the detection unit does not detect the contact area or when the recording unit performs recording.

Further, in this inkjet recording device of the present invention, the detection unit withdrawal unit also preferably withdraws the detection unit to a position at which said detection unit is located higher than the nozzle face with respect to the platen.

According to the inkjet recording device (as a first mode) of the present invention, when the detection unit provided between the standby position of the platen prior to the start of recording and the recording unit detects a contact area in which the recording medium contacts the nozzle face, the feed mechanism control unit stops feeding the platen or feeds the platen to the standby position. As a result, wrinkles and foreign particles in the recording medium can be detected reliably, and the inkjet recording device of the present invention can be realized more easily and inexpensively.

Further, in the inkjet recording device of the present invention, when a detection unit withdrawal unit for withdrawing the detection unit to a position at which said the detection unit does not contact the recording medium after the recording is completed is provided, it is possible to prevent the recording medium subjected to recording from contacting the detection unit, and to thereby prevent the recording medium or detection unit from becoming tainted or damaged.

Moreover, in the inkjet recording device of the present invention, when the detection unit is withdrawn to a position at which said detection unit is at least 0.5 mm apart from the recording medium after the recording is completed, it is possible to reliably prevent the recording medium subjected to recording from contacting the detection unit.

Further, in the inkjet recording device of the present invention, when the detection unit is withdrawn to a position at which the detection unit is located higher than the nozzle face with respect to the platen when the detection unit does not detect the contact area or when the recording unit performs recording, it is possible to reliably prevent the recording medium subjected to recording from contacting the detection unit.

Moreover, in the inkjet recording device of the present invention, the detection unit preferably has a plate-like member capable of contacting the contact area, a concealing member provided integrally to the plate-like member for determining whether or not the contact area was detected, and a sensor unit for detecting the concealing member. Since the plate-like member rotates upon contacting the recording medium, and the concealing member also rotates pursuant thereto, the contact area of the recording medium can be detected by the sensor unit detecting the rotation of the concealing member. As a result, wrinkles and foreign particles in the recording medium can be detected reliably, and the inkjet recording device of the present invention can be manufactured more easily and inexpensively.

Further, in the inkjet recording device of the present invention, when the detection unit is rotated and withdrawn, it is possible to prevent the recording medium subjected to recording from contacting the detection unit, and to thereby prevent the recording medium or detection unit from becoming tainted or damaged.

Moreover, in the inkjet recording device of the present invention, when an actuator which presses and rotates the detection unit is provided in the vicinity of the detection unit, it is possible to prevent the recording medium subjected to recording from contacting the detection unit more easily and inexpensively.

Further, in the inkjet recording device of the present invention, when the recording medium is fabric, the present invention may be employed in an inkjet printer for fabric to be used for recording on fabric such as a T-shirt.

Moreover, in the inkjet recording device (as a second mode) of the present, when the detection unit detects a contact area in which the recording medium contacts the nozzle face, the feed mechanism control unit stops feeding the platen or feeds the platen to the standby position, and, when the recording is completed, the detection unit withdrawal unit withdraws the detection unit to a position that does not contact the recording medium after the recording is completed. As a result, in addition to wrinkles and foreign particles in the recording medium can being detected reliably, it is possible to prevent the recording medium subjected to recording from contacting the detection unit, and to thereby prevent the recording medium or detection unit from becoming tainted or damaged.

Further, in the inkjet recording device (as a second mode) of the present invention, when the detection unit is withdrawn to a position at which said detection unit is at least 5 mm apart from the recording medium after the recording is completed, it is possible to reliably prevent the recording medium subjected to recording from contacting the detection unit.

Moreover, in the inkjet recording device (as a second mode) of the present invention, when the detection unit is withdrawn when the detection unit does not detect the contact area or when the recording unit performs recording, it is possible to reliably prevent the recording medium subjected to recording from contacting the detection unit.

Further, in the inkjet recording head (as a second mode) of the present, when the detection unit is withdrawn to a position at which said detection unit is located higher than the nozzle face with respect to the platen, it is possible to reliably prevent the recording medium subjected to recording from contacting the detection unit.

DESCRIPTION OF THE PREFERRED EMBODIMENTS

Figure 1:
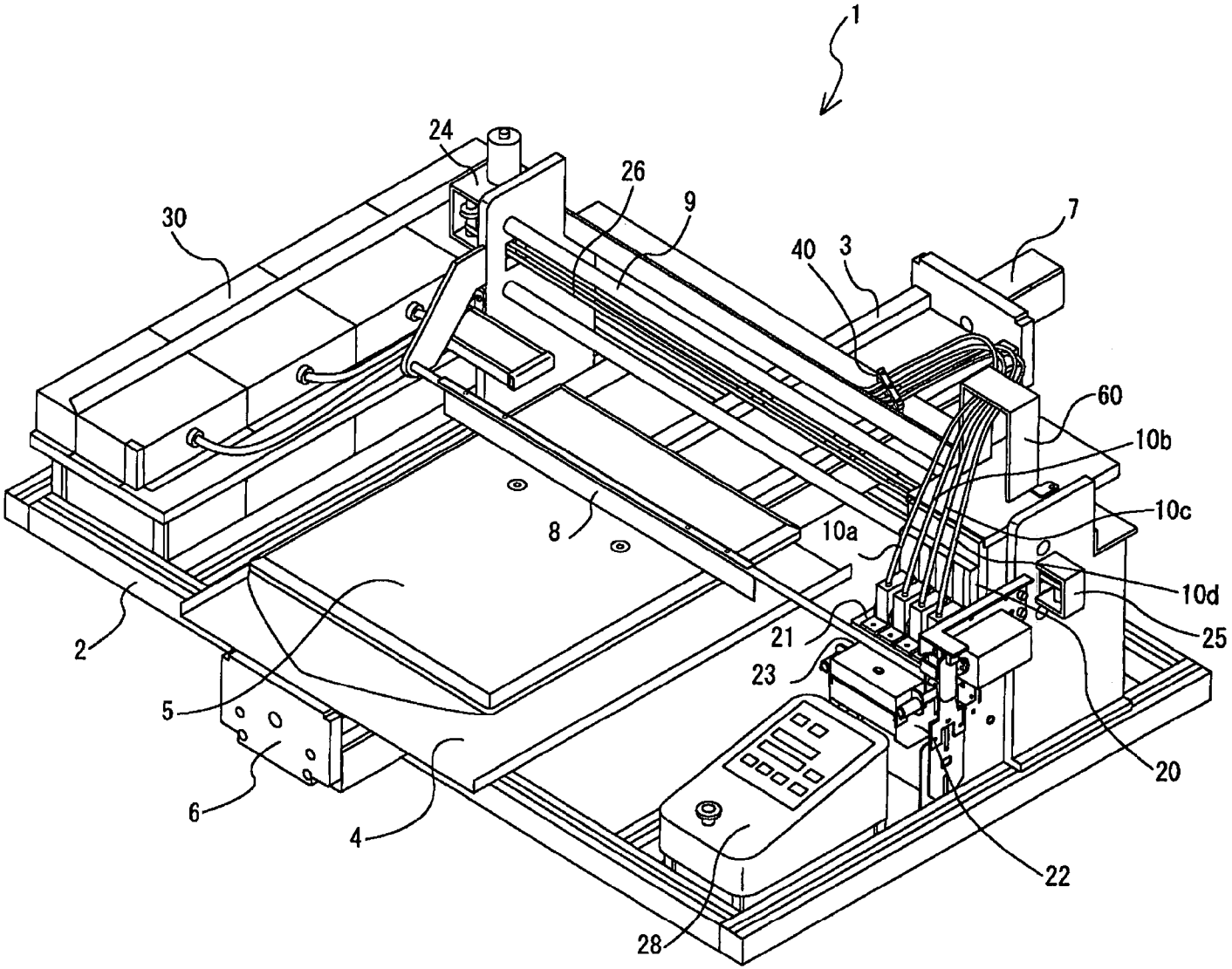
FIG. 1 is an external perspective view of the inkjet printer 1 according to the first embodiment.

The first embodiment of the inkjet recording device realizing the present invention is now explained with reference to the drawings. Foremost, the overall constitution of an inkjet printer 1, which is an example of the inkjet recording device, is explained with reference to FIG. 1. FIG. 1 is an external perspective view of the inkjet printer 1 according to the first embodiment. In the present embodiment, the inkjet printer 1 is a professional-use inkjet printer for printing on fabric such as T-shirts based on the input image information or the like.

As shown in FIG. 1, the inkjet printer 1 has an approximately cuboid case 2 with the right and left direction (or the horizontal direction) thereof being the longitudinal direction, and two rails 3 are arranged facing the back and forth direction (or the cross direction) at the approximate center of the bottom face thereof. These two rails 3 are respectively supported on the base portion (not shown) set up in the vertical direction of the case 2, and a tabular platen support (not shown) movable in the cross direction of the case 2 along the rails 3 is supported at the top portion thereof. And, a replaceable platen 5 is fixed to the upper end of the columnar support set up vertically to the approximate center of the platen support.

The platen 5, in a plan view, is an approximately rectangular plate with the cross direction of the case 2 as the longitudinal direction thereof, and is used for horizontally mounting on the top face thereof a recording medium formed from fabric such as a T-shirt. Provided to the top face of the platen 5 is a non-slip member (not shown) for preventing the mounting position of a T-shirt or the like mounted with the printing surface thereof in a state of tension from slipping during the printing. Further, a tray fixed with a columnar support to a position approximately in the middle of the platen 5 and the platen support has a bottom face approximately parallel with the top face of the platen 5, and, in a plan view, the outer periphery of the tray is constituted to be slightly larger than the platen 5. This tray 4 receives the sleeve or the surplus portion of the T-shirt or the like upon the user mounting such T-shirt on the platen 5, and is used for preventing the T-shirt from falling to the bottom face of the case 2.

Moreover, a platen drive motor 7 is provided to the rear end of a platen drive mechanism 6, which is provided with a rail 3 for moving the platen support, and, as a result of this platen drive motor 7 being driven, the platen support will move in the cross direction of the case 2 along the rail 3. In other words, a drive belt is placed around the drive axis of the platen drive motor 7 and the pulley provided in the vicinity of the front end of the rail 3 (end of the rail 3 which corresponds to the front side of the case 2), and the platen support fixed to the drive belt is able to reciprocate in the cross direction of the case 2 along the rail 3 based on the drive of the platen drive motor 7, which is a stepping motor. Incidentally, the front portion of the rail 3 is the standby position (default position) of the platen 5 before the start of printing.

Incidentally, although not shown, an optical sensor for detecting that the platen 5 moving from the rear to the front of the case 2 upon the performing of printing is at the terminal point of the moving direction is provided in the vicinity of the front end of the rail 3. Further, an optical sensor for detecting that the platen 5 is at the starting point of the moving direction upon the performing of printing and an optical sensor for detecting that the platen 5 is at the starting point upon reading are provided in the vicinity of the rear end of the rail 3. These optical sensors have a light emitting unit and a light receiving unit, and detect the target of detection based on whether the light emitted from the light emitting unit was received by the light receiving unit. And, a shield plate for blocking the space between the light emitting unit and light receiving unit of these optical sensors and detecting the position of the platen 5 via the optical sensors is protrusively provided on the lower face of the platen support. The platen drive motor 7 is a stepping motor, and the position detection of the platen 5 based on the drive control of the platen drive motor 7 is conducted on the basis of the position of the starting point and terminal point of the platen 5 detected as a result of the shield plate not shown being positioned between the light emitting unit and light receiving unit of these optical sensors. As a result, when printing is started, the platen 5 in which the front end portion of the rail 3 is standing by in a default position is fed to the rear end portion of the rail 3. Upon performing printing thereafter, movement control is conducted with the rear end portion of the rail 3 as the starting point toward the front end portion of the rail 3.

Further, at the approximate center in the cross direction of the case 2 and at the upper position of the platen 5, a guide rail 9 for guiding the movement of a carriage 20 mounting an inkjet head 21 is installed between both side faces of the case 2. A carriage belt 26 installed between a carriage motor 24 provided in the vicinity of the left end of this guide rail 9 and a pulley 25 provided in the vicinity of the right end thereof is disposed across either side of the case 2 at a position lower than the guide rail 9. The carriage belt 26 is fixed to the back face of the carriage 20, and, as a result of the carriage motor 24 being driven, the carriage 20 is able to reciprocate in the horizontal direction of the case 2 along the guide rail 9 engaged with the engagement unit similarly provided to the back face. The carriage motor 24 is a DC motor, and the positional detection of the carriage 20 is conducted based on the output from the linear encoder (not shown) provided to the guide rail 9.

Moreover, a clearance sensor 8 is provided across either side of the case 2 at a position more forward than the guide rail 9. When the platen 5 moves from the front to the rear of the case 2 along the rail 3 upon performing the recording, the clearance sensor 8 detects the wrinkles of the recording medium or obstacles such as dust.

The carriage 20 has an approximate cuboid shape, and four piezoelectric inkjet heads 21 are mounted on the bottom face thereof. These four inkjet heads 21 are, for instance, provided in correspondence with the four color inks of cyan, magenta, yellow and black, and respectively comprise, for example, 128 channels (not shown) for emitting a jet of the respective inks. Each channel is provided with a piezoelectric actuator (not shown) driven individually, and is controlled such that the droplets of ink are emitted in a jet downward from minute ejection nozzles formed at the bottom face of the inkjet head 21 in correspondence with the respective channels.

An ink cartridge housing unit 30 for detachably housing an ink cartridge housing the respective inks is respectively provided to the left side of the inkjet printer 1. Each ink cartridge housing unit 30 and each inkjet head 21 are respectively connected with ink supply tubes 10, and the ink housed in each ink cartridge housing unit 30 is supplied to each channel via each of the respectively connected ink supply tubes 10. In FIG. 1, provided is an ink cartridge housing unit 30 of four types of ink based on the CMYK method (cyan, magenta, yellow, black), and the ink supply tubes 10 are attached to the ink supply port of the respective ink cartridge housing units 30. The ink supply tubes 10 are flexible tubes formed from polyethylene or the like, and possess flexibility for creating bending or twisting in correspondence with the movement of the carriage 20.

The four ink supply tubes 10*a* to 10*d* illustrated in FIG. 1 are connected to the inkjet head 21 of each color from each ink cartridge housing unit 30 via the guide member 40 and the tube support member 60. The guide member 40 is provided at approximately the center in the horizontal direction of the case 2 and at an upward position of the platen 5, and is used for supporting the four ink supply tubes 10*a* to 10*d* at the rear of the carriage 20. Further, the tube support member 60 is provided to the upper end of the carriage 20 and is used for supporting the four ink supply tubes 10*a* to 10*d*. And, via this tube support member 60, each of the ink supply tubes 10*a* to 10*d* is attached to the inkjet heads 21 of the respective colors located immediately below the front of the tube support member 60 so as to supply ink inside the inkjet head 21.

Moreover, at the position where the carriage 20 moves to the right end of the guide rail 9, provided is a purge unit having a suction cap 23 capable of firmly attaching to and detaching from the nozzle face of the respective inkjet heads 21. The purge unit 22 is provided with a suction pump (not shown), and, when the respective suction caps 23 are firmly attached to the inkjet head 21, the suction of ink via the suction cap 23 is enabled. Further, when printing is not being conducted, the nozzle face of the inkjet head 21 is covered with the suction cap 23, and the drying of the ink is thereby prevented.

Further, an operation panel 28 for operating the inkjet printer 1 is provided at a position on the right front portion of the case 2. Moreover, a control unit 100 (not shown) having a CPU 110 or the like for controlling the inkjet printer 1 is provided inside the case 2, and the details thereof will be described later.

Figure 2:
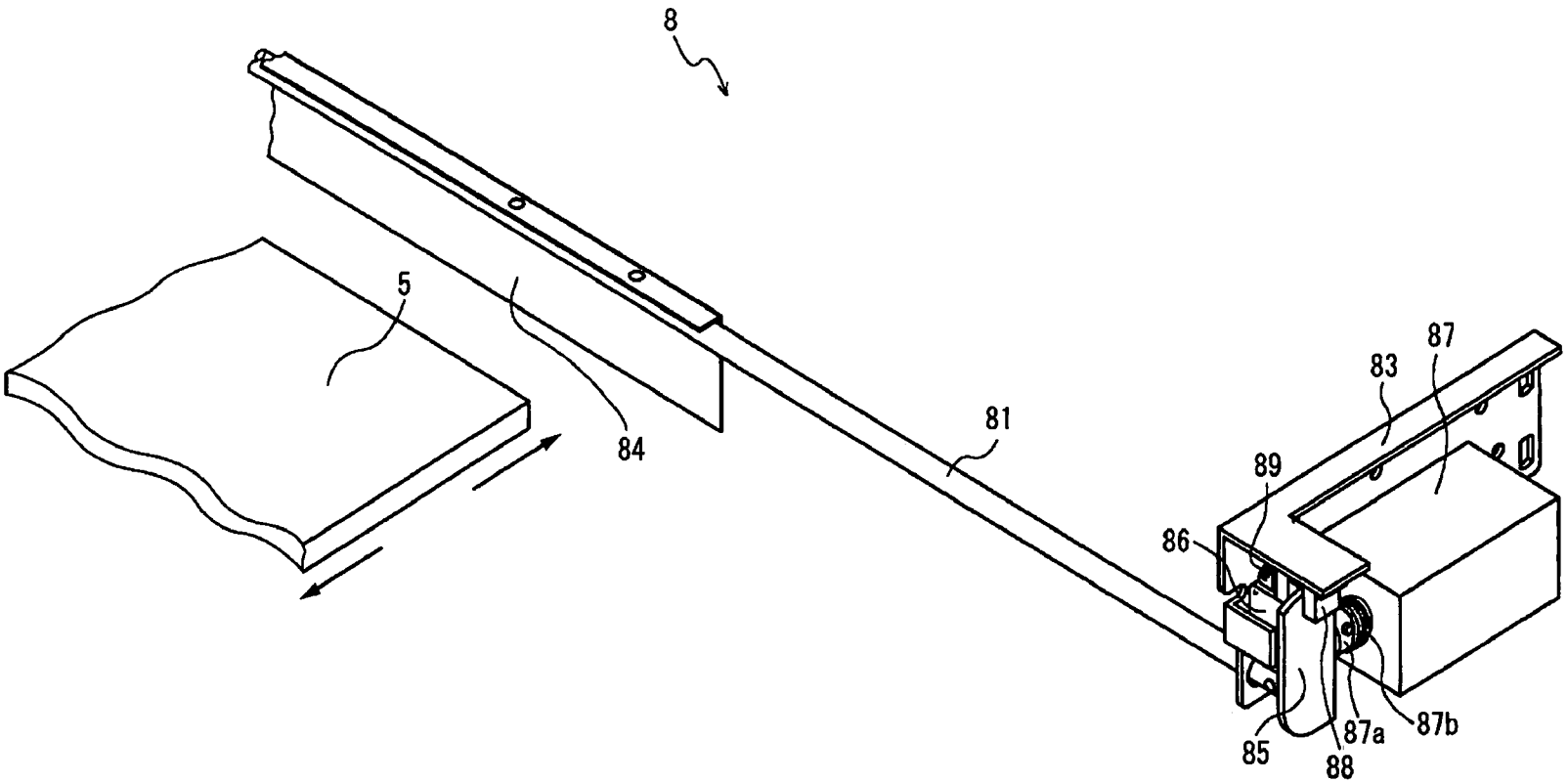
FIG. 2 is an external perspective view of the clearance sensor mechanism 8.
Figure 3:
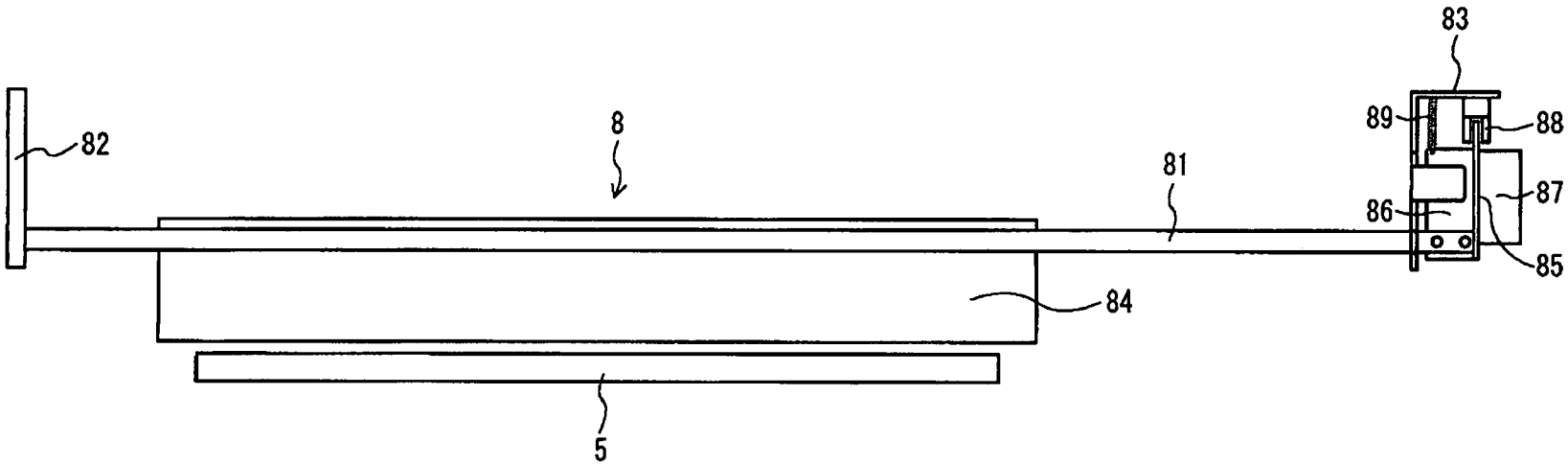
FIG. 3 is a front view of the clearance sensor mechanism 8.
Figure 4:
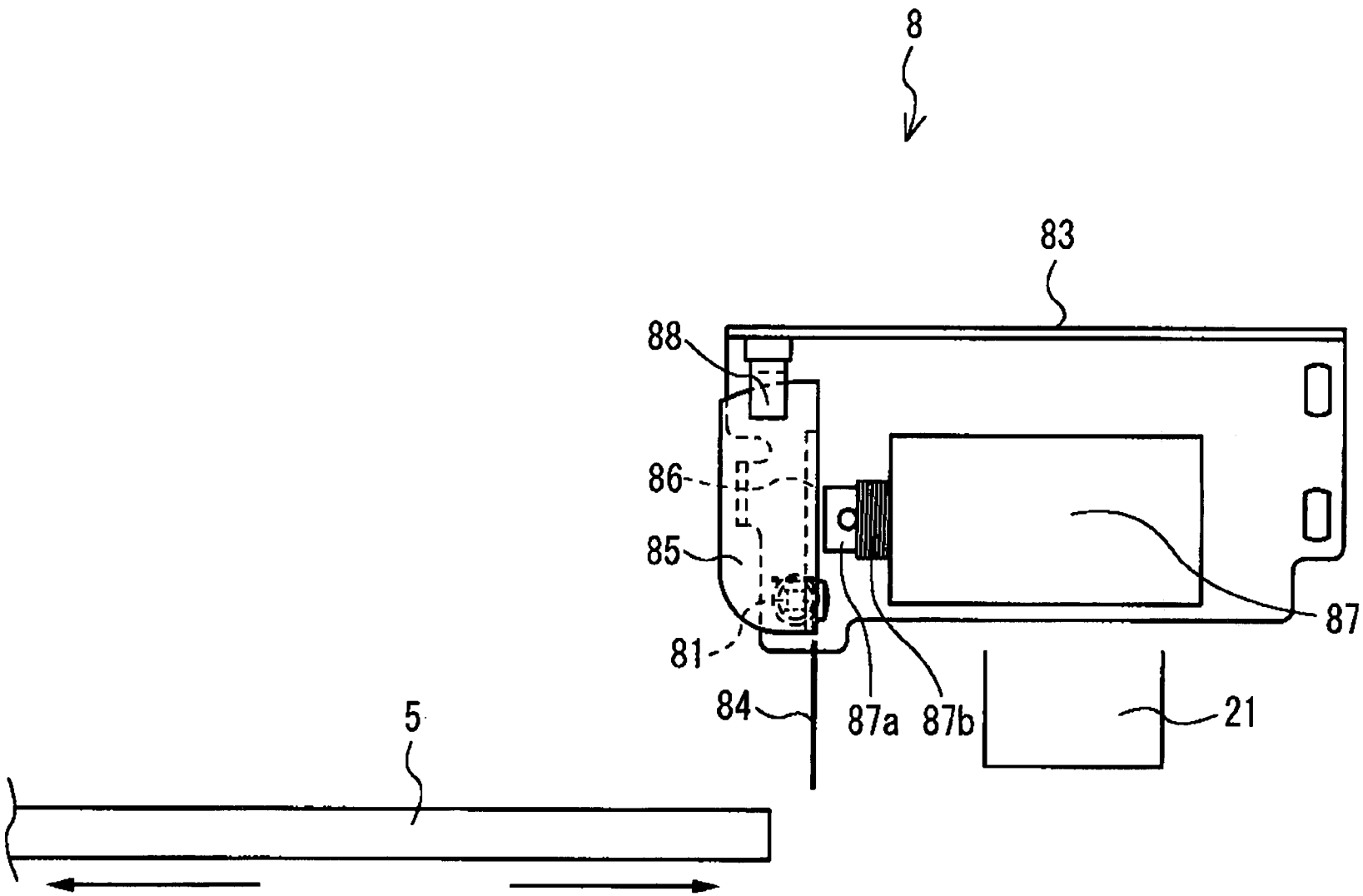
FIG. 4 is a right side view of the clearance sensor mechanism 8.

Next, the constitution of a clearance sensor mechanism 8 is explained with reference to FIG. 2 to FIG. 4. FIG. 2 is an external perspective view of the clearance sensor mechanism 8; FIG. 3 is a front view of the clearance sensor mechanism 8; and FIG. 4 is a right side view of the clearance sensor mechanism 8.

As shown in FIG. 2 and FIG. 3, with the clearance sensor mechanism 8, an axis member 81 provided between either side of the case 2 is axially supported with a base unit 82 fixed to the left end of the case 2 and a base unit 83 fixed to the left end of the case 2, and is capable of rotating about the axis line axially supported by the base unit 82 and base unit 83. Further, the axis member 81 is provided above the position in which the platen 5 is to be fed, in a direction orthogonal to the direction in which the platen 5 is to be fed, and in parallel with the surface of the platen 5. Meanwhile, the axis member 81 is provided forward with respect to the guide rail 9 for scanning the carriage 20, in a plan view, in parallel with the guide rail 9 for reciprocating the carriage 20 in the horizontal direction.

The feeding operation of the platen 5 upon printing is now explained. Incidentally, "upon printing" includes "upon starting printing" which feeds the platen 5 as a preparatory step of performing printing, and "upon performing printing" which feeds the platen 5 for actually performing printing. The platen 5 is fed in the cross direction of the case 2 along the rail 3, and the front end of the rail 3 is in a default position in which the platen 5 is on standby before the printing is started or after the printing has been performed. And, upon starting printing, the platen 5 standing by in the default position is fed along the rail 3 toward the rear end of the rail 3. And, when the platen 5 reaches the rear end of the rail 3, the feeding direction of the platen 5 is reversed upon performing printing, and the platen 5 is fed along the rail 3 from the rear end of the rail 3 toward the front end thereof. During this course, when the platen 5 reaches the printing performing position to be scanned by the inkjet head 21, the inkjet head 21 performs printing to the recording medium. When the inkjet head 21 finishes printing, the platen 5 with the recording medium mounted thereon is fed to the default position located at the front end of the rail 3, and the operation of upon performing printing is finished thereby. Incidentally, the following explanation is made on the assumption that the direction toward the front end of the rail 3 is the upstream of the feeding direction, and the direction toward the rear end of the rail 3 is the downstream of the feeding direction.

A plate-like member 84, which is a blade protruding from the axis member 81, is formed on the axis member 81, and this plate-like member 84 forms an approximate rectangle with the axis line direction of the axis member 81 as the longitudinal direction. This plate-like member 84 is provided upstream with respect to the feeding direction of the platen 5 when viewed from the scanning direction of the carriage 20, and in close vicinity above the platen 5. Specifically, as shown in FIG. 4, when the platen 5 is feed immediately beneath the plate-like member 84, the plate-like member 84 hangs from the axis member 81 such that the lower end of the plate-like member 84 approaches the platen 5 at a position where the lower end of the plate-like member 81 and the surface of the platen 5 are 3.7 to 4.2 mm apart. Further, the lower end of the plate-like member 84 hanging from the axis member 81 exists at a position that is approximately 0.5 mm lower than the height of the nozzle face of the inkjet head 21. Thus, the lower end of the plate-like member 84 hanging from the axis member 81 exists within the altitude difference between the nozzle face of the inkjet head 21 and the surface of the platen 5.

Incidentally, the reason why the lower end of the plate-like member 84 is positioned to be approximately 0.5 mm lower than the nozzle face of the inkjet head 21 and the altitude difference between the lower end of the plate-like member 84 and the surface of the platen 5 is made to be from 3.7 to 4.2 mm is based on the results of various experiments and research conducted in consideration of the thickness of the fabric (T-shirt or the like), which is the recording medium, the printing distance between the nozzle face of the inkjet head 21 and the recording medium, and so on. Incidentally, the length of the plate-like member 84 in the axis line direction is slightly longer than the width in the horizontal direction of the platen 5.

As described above, the plate-like member 84 hanging from the axis member 81 is formed as a curtain-like detection member across the horizontal direction of the platen 5, and, when there is a wrinkle or a foreign particle on the T-shirt or the like mounted on the platen 5 fed immediately therebelow, such wrinkle or foreign particle will contact the lower end of the plate-like member 84. And, when the wrinkle of the T-shirt or a foreign article contacts the plate-like member 84, the plate-like member 84 is constituted to rotate naturally about the axis line of the axis member 81 pursuant to the motive energy for feeding the platen 5.

Moreover, with the base unit 83 fixed to the left end of the case 2, in a front view, a concealing member 85 is provided to the right end of the axis member 81. The concealing member 85 is formed in an approximate rectangular plate-like shape, and is provided orthogonal to the axis member 81. Further, the approximately rectangular face of the concealing member 85 is parallel with the cross direction of the case 2, and, in a front view, the vertical direction is provided in the longitudinal direction. And, the axis member 81 is connected to the lower end of the concealing member 85. Thus, the vertical direction toward which the approximately rectangular face of the concealing member 85 extends forms a 180° angle with the vertical direction of the plate-like member 84 protruding from the axis member 81 around the axis line direction of the axis member 81.

The upper end of the approximately rectangular face of the concealing member 85 is concealed with the sensor 88, which is an optical sensor provided to the base unit 83. The sensor 88 is provided with a concave portion, and the sensor light is propagated between both sides inside this concave portion. The concave portion of the sensor 88 is provided to open downward, and the upper end of the approximate longitudinal face of the concealing member 85 is in a loosely fitted state of being fitted in this concave portion in a non-contact manner. And, the sensor 88 detects the concealing member 85 depending on whether the sensor light propagated between both sides inside this concave portion is blocked or is not blocked with the concealing member 85.

Further, in a front view, a receiving member 86, which is a blade protruding from the axis member 81, is provided to the right end of the axis member 81 in a direction of rotating 180° around the axis line direction of the axis member 81 in relation to the vertical direction of the plate-like member 84. The receiving member 86 forms an approximate rectangular plate-like shape, protrudes in the vertical direction from the axis member 81, and is connected so as to be orthogonal to the concealing member 85. One end of a spring 89 is connected to this receiving member 86, and the other end of the spring 89 is connected to the base unit 83. Based on the action of this spring 89, at normal times, the receiving member 86 is retained in a state of standing upright vertically from the axis member 81. In addition, the concealing member 85 which is formed integrally with the receiving member 86 will also be retained in the vertical direction, and the top end thereof will be loosely fit inside the concave portion and block (conceal) the sensor light. In addition, the plate-like member 84 protruding in a direction rotated 180° in relation to the axis line direction of the axis member 81 when viewed from the receiving member 86 is retained in a state of hanging in the vertical direction from the axis member 81.

Meanwhile, in a front view, a solenoid 87 is provided to the base unit 83 behind the receiving member 86. The solenoid 87 employs the magnetic action generated upon flowing current to a coil to convert electrical energy into a mechanical linear motion, and expands and contracts a movable member 87*a*, which is a protruding portion, in the cross direction. A spring 87*b* is wound around the movable member 87*a*, and, based on the action of this spring 87*a*, when the solenoid 87 is inoperative, the movable member 87*a* is retained in a state of being extended in the front direction (forward direction) of the case 2.

The solenoid 87, during operations, perform a suction operation to the movable member 87*a* to the rear face direction (back direction) of the case 2, and is retained such that the protruding portion of the movable member 87*a* becomes short. Here, when printing with the inkjet head 21 is performed, the suction operation is suspended and the movable member 87*a* is released. Then, due to the action of the spring 87*b*, the movable member 87*a* will return to the state of being extended in the front direction (forward direction) of the case 2.

When the movable member 87*a* of the solenoid 87 is extended in the front direction (forward direction) of the case 2, the movable member 87*a* will contact the rear face of the receiving member 86, and will press the receiving member 86 to the front direction (forward direction) of the case 2. Then, the receiving member 86 will incline in the front direction (forward direction) of the case 2 around the axis direction of the axis member 81. When the receiving member 86 is inclined, the concealing member 85 connected with the receiving member 86 will also incline in the front direction (forward direction) of the case 2 around the axis direction of the axis member 81. Contrarily, the plate-like member 84 protruding in a direction 180° opposite to the axis line direction of the axis member 81 is constituted to incline in the rear direction (back direction) of the case 2 around the axis direction of the axis member 81.

Figure 5:
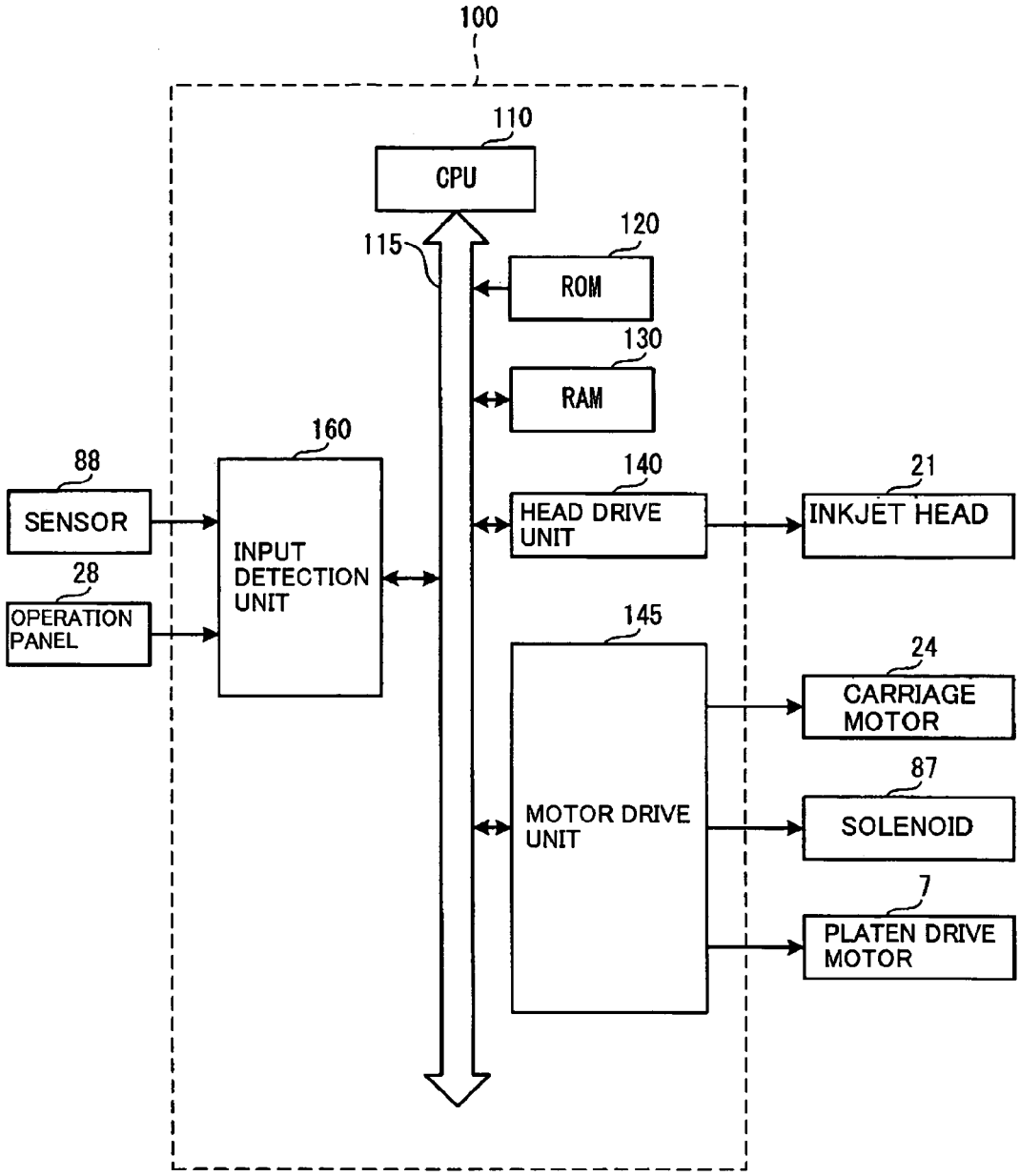
FIG. 5 is a block diagram showing the electrical constitution of the inkjet printer 1 according to the first embodiment.

Next, the electrical constitution of the inkjet printer 1 is explained. FIG. 5 is a block diagram showing the electrical constitution of the inkjet printer 1 according to the first embodiment.

As shown in FIG. 5, a control unit 100 of the inkjet printer 1 has a CPU 110 for handling the overall control of the inkjet printer 1, and connected to the CPU 110 are, via a bus 115, a ROM 120 storing various control programs to be performed by the CPU 110, and a RAM 130 for temporarily storing data. Also connected to the CPU 110 are, via the bus 115, a head drive unit 140 for driving a piezoelectric actuator provided to the respective channels of the inkjet head 21, and a motor drive unit 145 for driving a carriage motor 24 and platen drive motor 7. Further, the motor drive unit 145 is connected to a solenoid having a clearance sensor mechanism 8, and controls the operation of the solenoid 87. Moreover, an input detection unit 160 is connected to the operation panel 28 or an optical sensor not shown. In addition, the input detection unit 160 is connected to the sensor 88 having a clearance sensor mechanism 8, and the concealing member 85 is detected with the sensor light propagating inside the concave portion of the sensor 88.

According the foregoing electrical constitution, when the start of printing is designated from the operation panel 28, the movable member 87*a* will be subjected to a suction operation with the motor drive unit 145 in the solenoid 87. Meanwhile, when the sensor 88 does not detect the concealing member 85, feeding of the platen 5 with the carriage motor 24 is discontinued, or the platen 5 is fed to a default position. Further, when the printing with the inkjet head 21 is started pursuant to the head drive unit 140, the suction operation of the movable member 87*a* with the motor drive unit 145 is suspended in the solenoid 87, and the movable member 87*a* is released. In the present embodiment, the control of the respective mechanisms is realized by the CPU 110 executing the various control programs stored in the ROM 120, but this may also be realized by controlling such mechanisms based on a hardware constitution such as an electrical circuit.

The operation during printing of the inkjet printer 1 of the first embodiment is now explained with reference to the drawings. In particular, since the operation of the platen 5, inkjet head 21 and clearance sensor mechanism 8 during printing is explained, only the related constitutions are illustrated in the diagrams.

Figure 6:
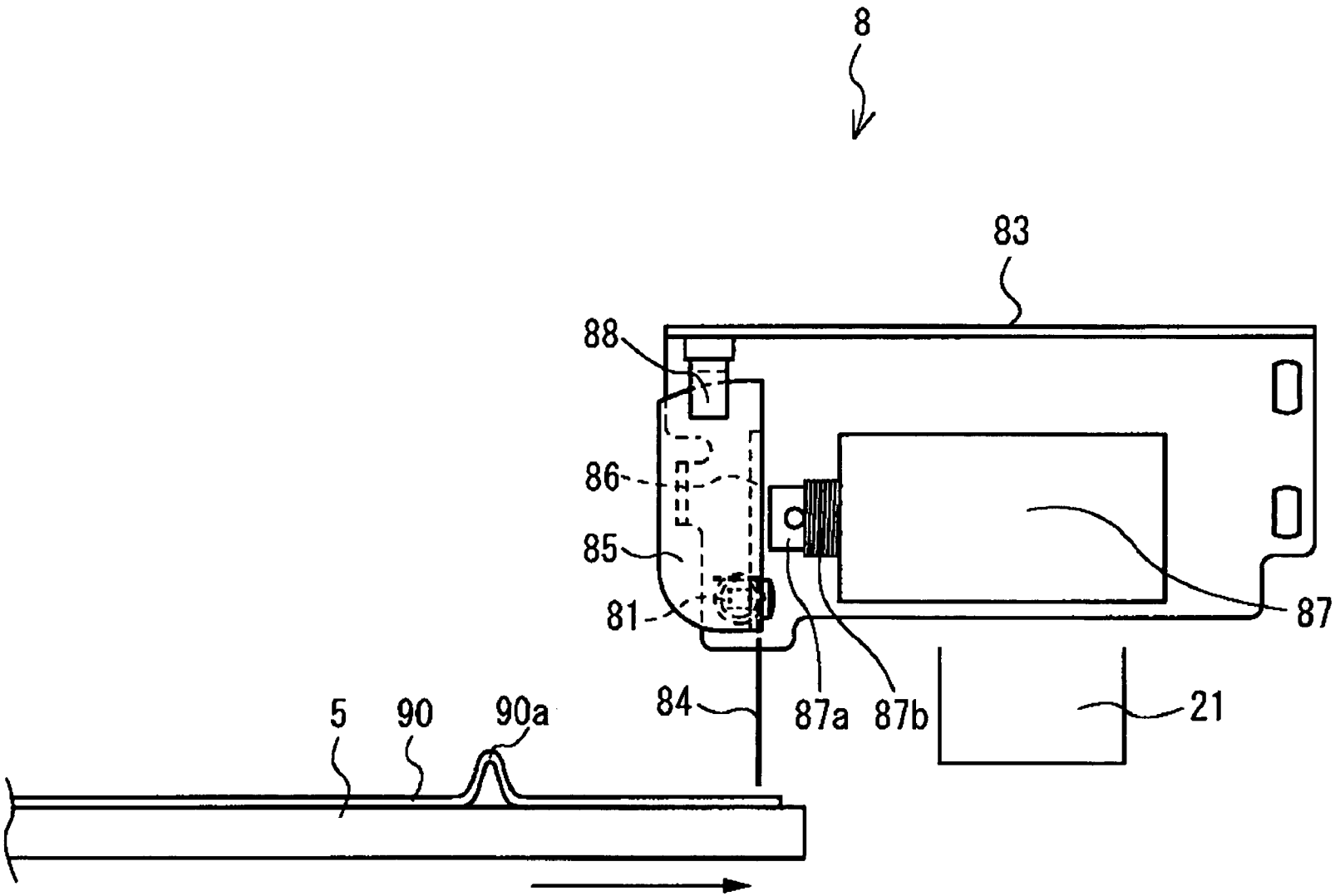
FIG. 6 is a right side schematic view showing the inkjet printer 1 during printing when an obstacle exists in the recording medium.
Figure 7:
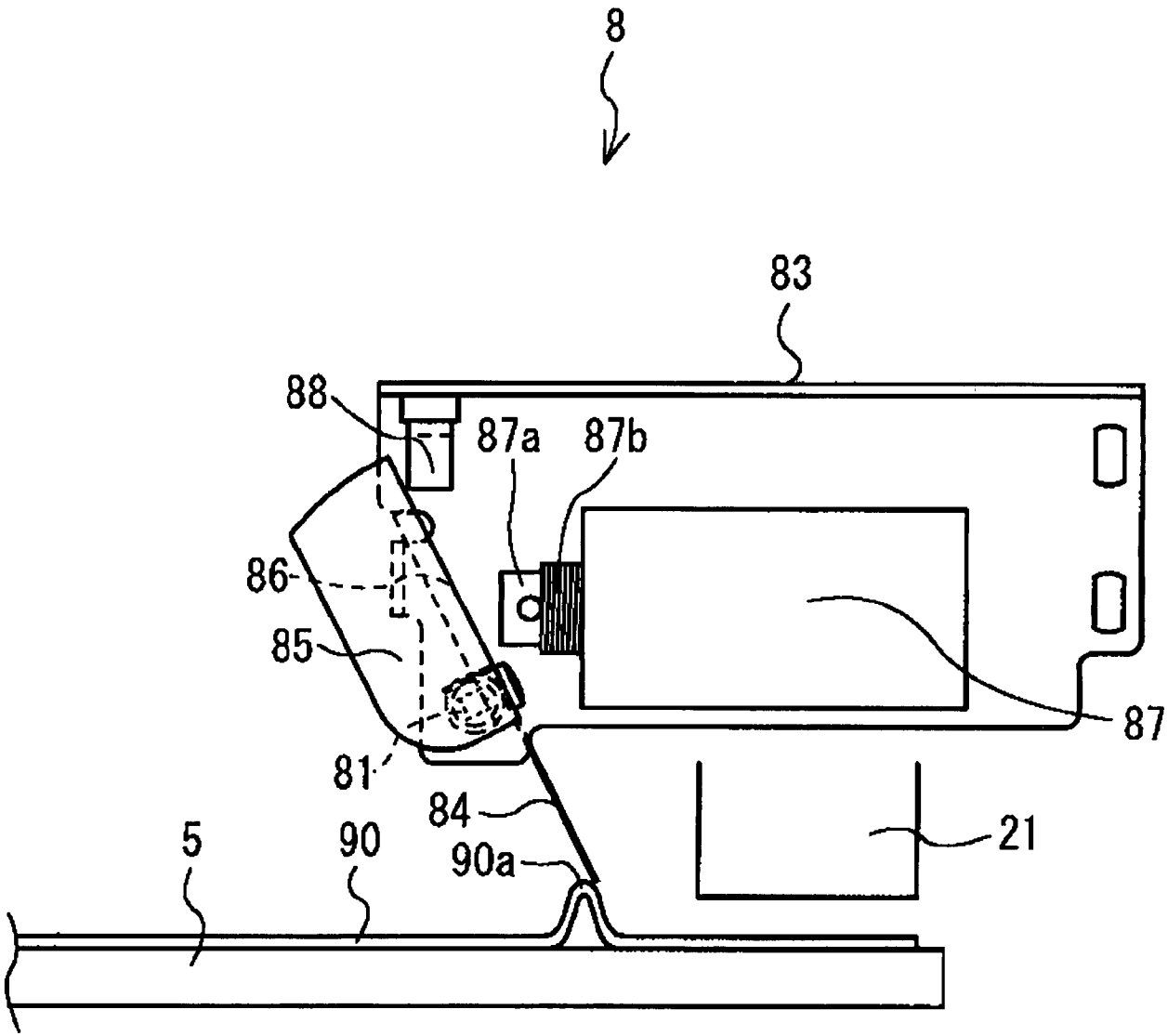
FIG. 7 is another right side schematic view showing the inkjet printer 1 during printing when an obstacle exists in the recording medium.
Figure 8:
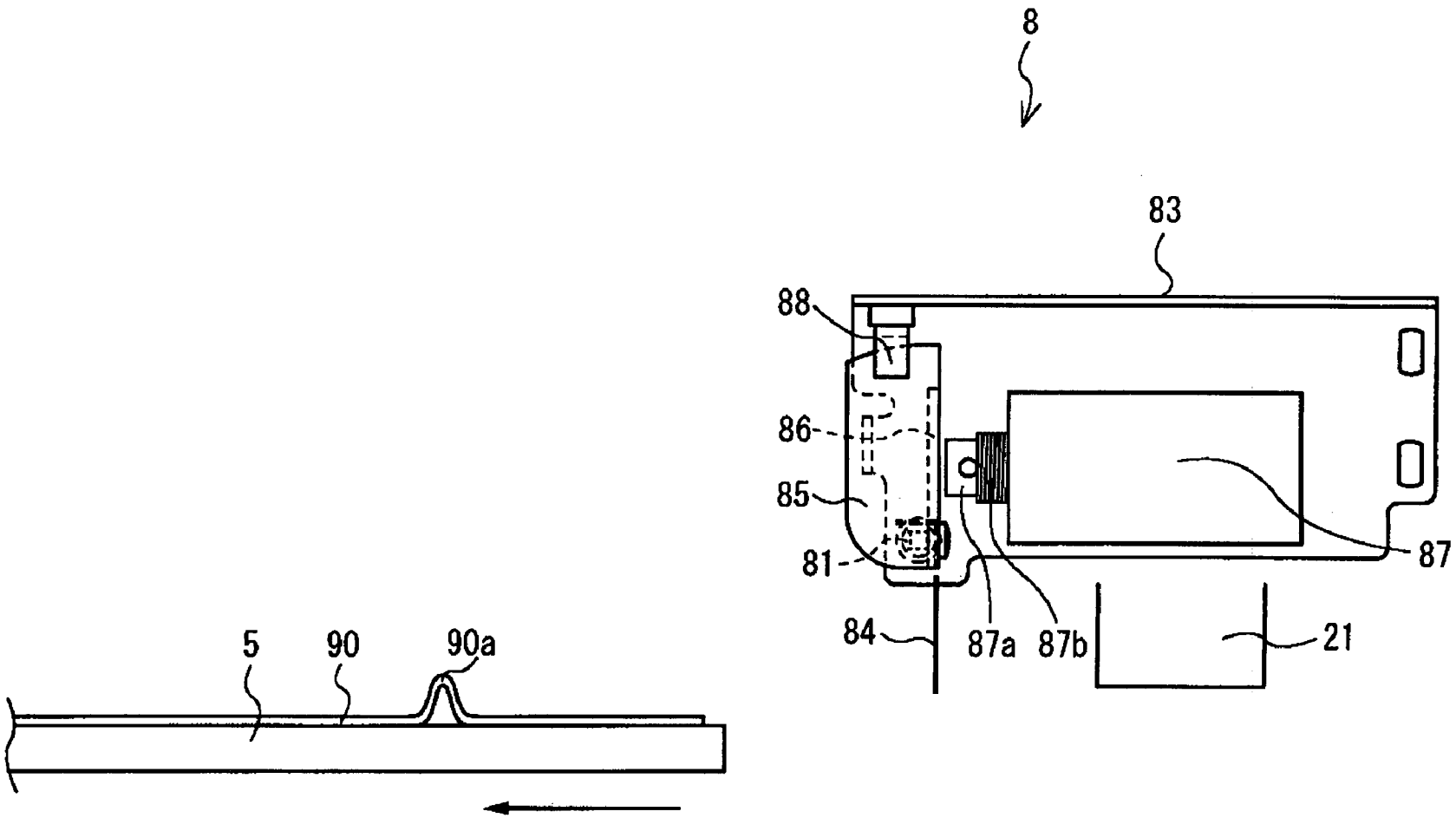
FIG. 8 is another right side schematic view showing the inkjet printer 1 during printing when an obstacle exists in the recording medium.

Foremost, the operation of the inkjet printer 1 when an obstacle such as a foreign particle or wrinkle exists in the recording medium mounted on the platen 5 is explained with reference to FIG. 6 to FIG. 8. FIG. 6 is a right side schematic view showing the inkjet printer 1 during printing when an obstacle exists in the recording medium; FIG. 7 is another right side schematic view showing the inkjet printer 1 during printing when an obstacle exists in the recording medium; and FIG. 8 is another right side schematic view showing the inkjet printer 1 during printing when an obstacle exists in the recording medium.

When the start of printing is designated from the operation panel 28, the movable member 87*a* is subjected to suction operation by the motor drive unit 145 in the solenoid 87, and retained such that the protruding portion of the movable member 87*a* becomes shorter. Thus, as shown in FIG. 6, the receiving member 86 and the concealing member 85 are retained in the vertical direction, and the upper end thereof is loosely fitted inside the concave portion of the sensor 88 and blocks (conceals) the sensor light. Further, the plate-like member 84 protruding in a direction 180° opposite to the axis line direction of the axis member 81 when viewed from the receiving member 86 is retained in state of hanging vertically from the axis member 81. Incidentally, since the axis member 81 and receiving member 86 are hidden behind the concealing member 85, these are illustrated with a dotted line.

The platen 5 having mounted thereon a T-shirt 90 which is the target recording object is fed from the default position located at the front end of the rail 3 toward the rear end of the case 2. In FIG. 6, the left direction is the front of the rail 3, and the upstream of the feeding direction upon starting printing. Further, the rightward direction is the rear of the rail 3, and is the downstream of the feeding direction upon starting printing. Although the platen 5 is thus fed from upstream to downstream of the feeding direction upon starting printing, the plate-like member 84 is hanging from the axis member 81 in a curtain-like manner above the platen 5 at a position in front of the printing performing position to be scanned by the inkjet head 21. And, when the platen 5 being fed reaches immediately beneath the plate-like member 84, a gap is formed between the lower end of the plate-like member 84 and the surface of the platen 5, the T-shirt 90 as the recording medium passes through this gap, further passes through immediately beneath the printing performing position to be scanned by the inkjet head 21, and is fed to the rear end of the rail 3.

Incidentally, a wrinkle 90*a* unique to fabric is formed in the T-shirt 90 mounted on the platen 5, and the height of portion with this wrinkle 90*a* is greater than the gap between the lower end of the plate-like member 84 and the surface of the platen 5. Thus, as shown in FIG. 7, among the area of the T-shirt 90 mounted on the platen 5 being fed, when the portion with the wrinkle 90*a* reaches immediately beneath the plate-like member 84, the plate-like member 84 and the wrinkle 90*a* will contact each other. Here, since the axis member 81 is able to rotate around the axis line direction, as a result of the plate-like member 84 and the wrinkle 90*a* contacting each other, the plate-like member 84 will rotate naturally according to the motive force toward the feeding direction of the platen 5. As a result, as shown in FIG. 7, the plate-like member 84, when viewing the case 2 from the right side thereof, rotates in a counterclockwise direction around the axis line direction of the axis member 81. In other words, the plate-like member 84 inclines in the rear direction (back direction) of the case 2 around the axis line direction of the axis member 81.

Meanwhile, as a result of this rotation, the concealing member 85 and receiving member 86 that were retained in an upright state vertically from the axis member 81, as shown in FIG. 7, will also rotated in the counterclockwise direction pursuant to the rotation of the axis member 81. As a result of this rotation, since the concealing member 85 will incline in the front direction (forward direction) of the case 2, the upper end of the concealing member 85 will move outside the concave portion of the sensor 88. Then, the sensor light that was blocked (concealed) with the concealing member 85 at the concave portion of the sensor 88 will pass through, and the sensor 88 will become a state of not detecting the concealing member 85.

When the sensor 88 does not detect the concealing member 85, the feeding of the platen 5 with the carriage motor 24 is suspended, or is controlled to feed the platen 5 to the default position at the front end of the rail 3. In the present embodiment, when the sensor 88 does not detect the concealing member 85, the carriage motor 24 will operate so as to feed the platen 5 to the default position. As a result, as shown in FIG. 8, the platen 5 will be fed to a direction opposite to the feeding direction, and returned to the default position before the start of printing.

Incidentally, when the sensor is in a non-detection state and the feeding of the platen 5 is discontinued or controlled so as to feed the [platen 5] to the default position, the axis member 81 (plate-like member 84, concealing member 85, receiving member 86) will rotate to the extent that the concealing member 85 will not move outside the concave portion of the sensor 88.

As described above, the clearance sensor mechanism 8 can be used to reliably detect foreign particles and wrinkles on the recording medium. Further, when the clearance sensor mechanism 8 detects a foreign particle or wrinkle on the recording medium, since the feeding of the platen 5 is suspended, or the platen 5 is fed to a direction opposite to the feeding direction at the start of printing, it is possible to prevent such a foreign particle or wrinkle on the recording medium from contacting the nozzle face of the inkjet head 21. In addition, unlike the conventional method of directly detecting obstacles such as foreign particles and wrinkles with an optical sensor, the clearance sensor mechanism 8 does not have to be equipped with a high-precision optical sensor, and the detection of foreign particles and wrinkles on the recording medium can be realized more easily and inexpensively.

Figure 9:
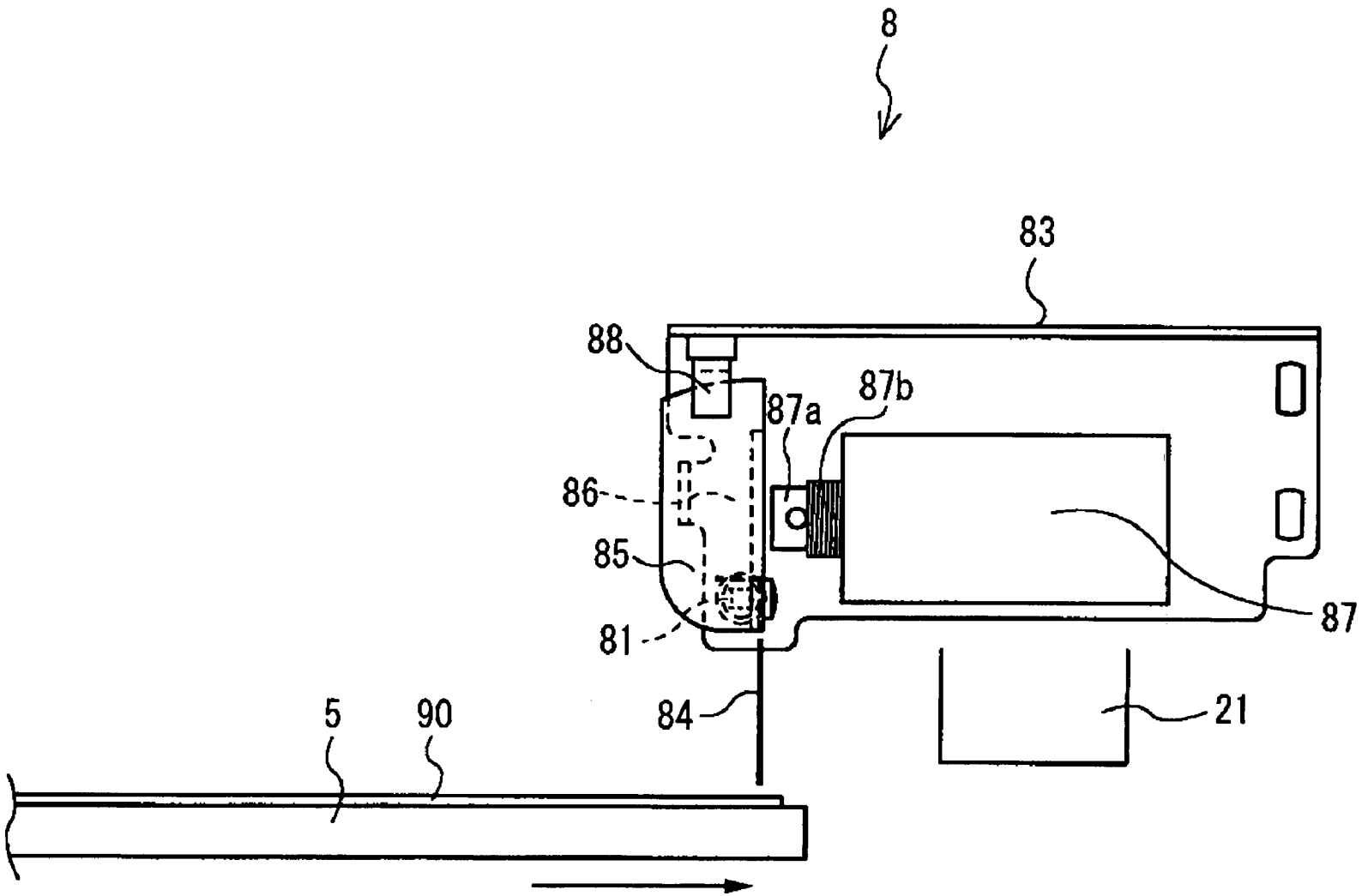
FIG. 9 is a right side schematic view showing the inkjet printer 1 during printing when an obstacle does not exist in the recording medium.
Figure 10:
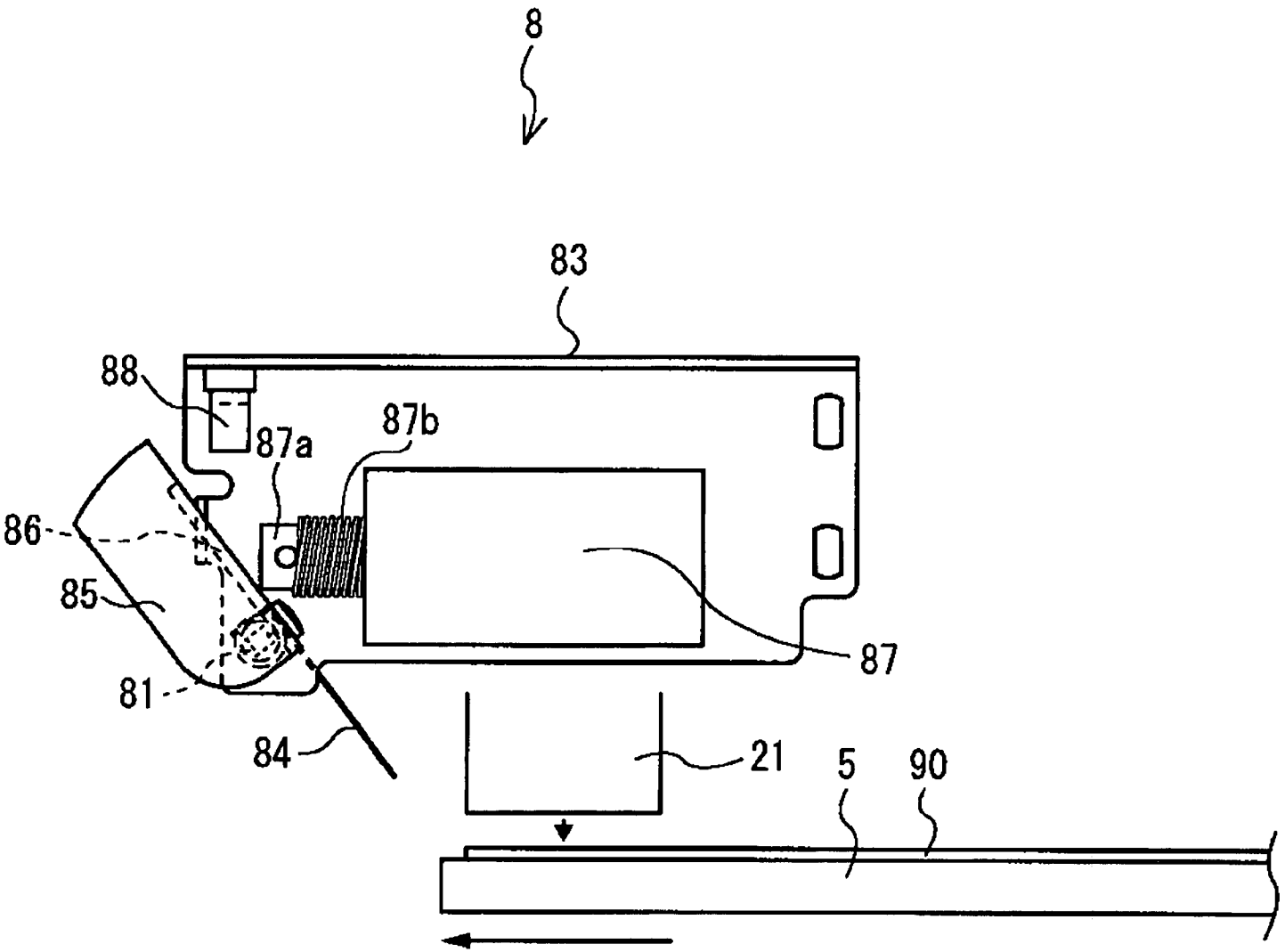
FIG. 10 is another right side schematic view showing the inkjet printer 1 during printing when an obstacle does not exist in the recording medium.
Figure 11:
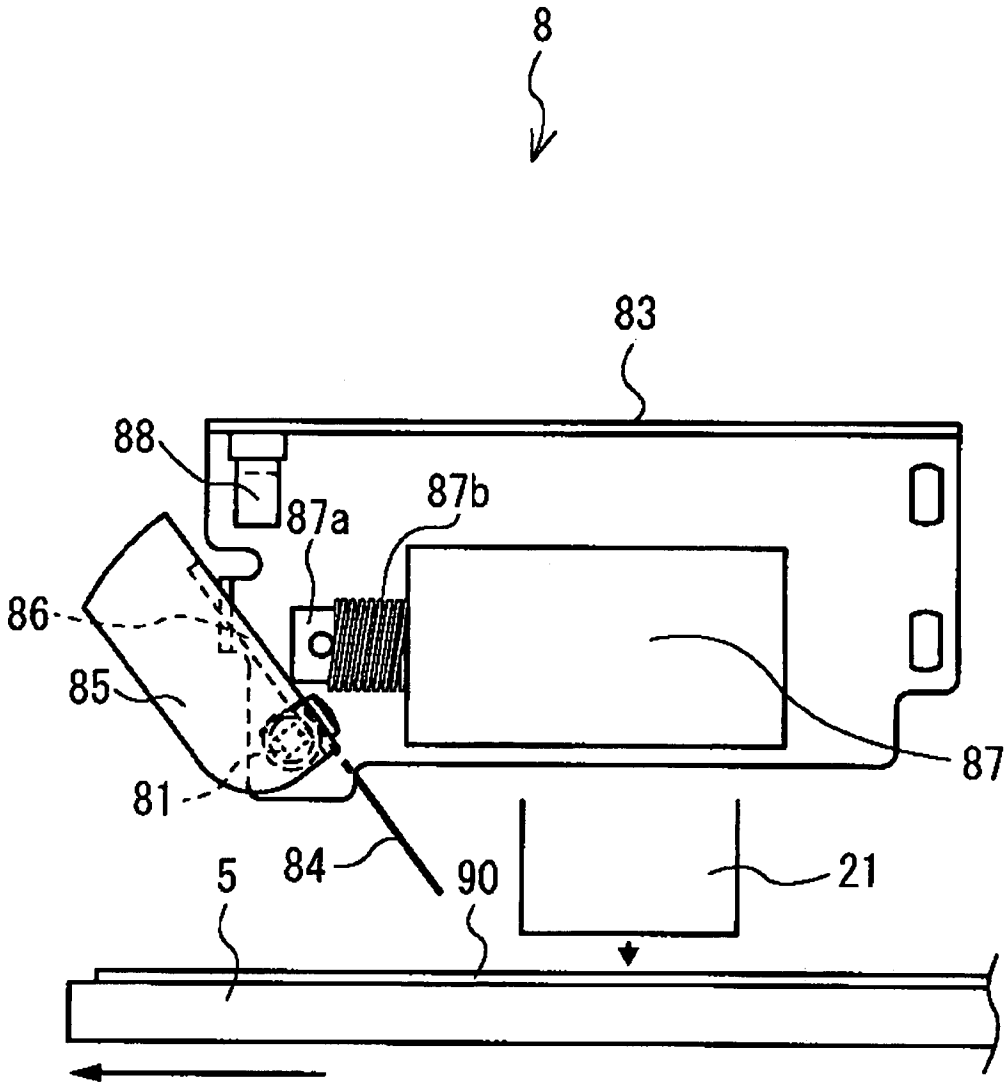
FIG. 11 is another right side schematic view showing the inkjet printer 1 during printing when an obstacle does not exist in the recording medium.

Next, the operation of the inkjet printer in a case where a normal printing operation is performed without the existence of any obstacles such as foreign particles or wrinkles on the recording medium mounted on the platen 5 is explained with reference to FIG. 9 to FIG. 11. FIG. 9 is another right side schematic view showing the inkjet printer 1 during printing when an obstacle does not exist in the recording medium; FIG. 10 is another right side schematic view showing the inkjet printer 1 during printing when an obstacle does not exist in the recording medium; and FIG. 11 is another right side schematic view showing the inkjet printer 1 during printing when an obstacle does not exist in the recording medium.

As shown in FIG. 9, the difference between FIG. 6 and FIG. 9 is in that no obstacle such as a foreign particle or wrinkle exists on the T-shirt 90 mounted on the platen 5. Thus, when the platen 5 with the T-shirt 90 mounted thereon is fed, since the T-shirt 90 and the plate-like member 84 will not contact each other upon the T-shirt 90 passing immediately beneath the plate-like member 84, the platen 5 with the T-shirt 90 mounted thereon will pass immediately beneath the printing performing position to be scanned with the inkjet head 21, and be fed to the rear end of the rail 3. When reaching the rear end of the rail 3, the feeding direction is reversed, and the platen 5 is fed toward the front end of the rail 3.

Then, as shown in FIG. 10, when the platen 5 with the T-shirt mounted thereon reaches the printing performing position to be scanned by the inkjet head 21, printing to the T-shirt 90 with the inkjet head 21 is started. When the printing with the inkjet head 21 is started, the suction operation of the movable member 87*a* by the solenoid 87 is suspended, and the movable member 87*a* is released. As a result, the movable member 87*a* is returned to a state of being extended in the front direction (forward direction) of the case 2, the movable member 87*a* will contact the rear face of the receiving member 86, and press the receiving member 86 in the front direction (forward direction) of the case 2.

Pursuant to the pressing of this movable member 87*a*, as shown in FIG. 10, when viewing the case 2 from the right side thereof, the axis member 81 will rotate in the counterclockwise direction around the axis line direction of the axis member 81. Thus, the concealing member 85 and receiving member 86 will incline in the front direction (forward direction) of the case 2 around the axis line direction of the axis member 81, and the plate-like member 84 will incline in the rear direction (back direction) of the case 2 around the axis line direction of the axis member 81. And, the axis member 81 (plate-like member 84, concealing member 85, receiving member 86), in an inclined state, is supported and fixed with the movable member 87*a* from behind the receiving member 86. As a result, the lower end of the plate-like member 84 will be retained at a higher position and the altitude difference between the plate-like member 84 and the surface of the platen 5 will become greater, the gap between the lower end of the plate-like member 84 and the surface of the platen 5 that is formed when the platen 5 being fed reached immediately beneath the plate-like member 84 will become larger. Thus, it is possible to prevent the T-shirt 90 mounted on the planted 5 from contacting the plate-like member 84 when the platen 5 being fed passes immediately beneath the plate-like member 84.

Under the foregoing circumstance, the platen 5 is fed from the rear end of the rail 3 to the front end thereof, and printing is performed with the scanning of the inkjet head 21. The platen 5 will further pass immediately beneath the printing performing position to be scanned by the inkjet head 21, is fed to the default position located at the front end of the rail 3 after the printing is performed, and the printing operation is completed thereby.

Incidentally, when printing is started pursuant to the inkjet head 21, as a result of the suction operation of the movable member 87*a* by the solenoid 87 being discontinued, the axis member 81 (plate-like member 84, concealing member 85, receiving member 86) will rotate according to the length in which the movable member 87*a* is extended. In other words, the longer the protruding portion of the movable member 87*a*, the larger the rotational angle of the axis member 81 (plate-like member 84, concealing member 85, receiving member 86). In the present embodiment, the protruding portion of the movable member 87*a* is extended (lengthened) to an extent where the lower end of the plate-like member 84 at least reaches a position higher than the nozzle face of the inkjet head 21. Specifically, it is preferable to rotate the plate-like member 84 so as to secure at least 5 mm for the altitude difference between the lower end of the plate-like member 84 and the T-shirt 90 mounted on the platen 5, and the protruding portion of the movable member 87*a* may be extended (lengthened) to such extent.

As described above, when printing is started with the inkjet head 21, the clearance sensor mechanism 8 will rotate so as to broaden the gap with the platen 5. Since the clearance sensor mechanism 8 is made to withdraw so as to avoid contacting the recording medium mounted on the platen 5, it is possible to prevent the recording medium and clearance sensor mechanism 8 from becoming damaged or tainted. In particular, immediately after the printing is performed on the recording medium by the inkjet head 21, the ink ejected on the recording medium is not yet completely dried, and hence ink taint due to contact will easily occur. Moreover, since the recording medium will swell due to the ink immediately after printing, the possibility of contacting the clearance sensor 8 will increase. Thus, the point of the clearance sensor mechanism 8 withdrawing so as to avoid contacting the recording medium is extremely effective.

As described above, according to the inkjet printer 1 of the first embodiment, when the clearance sensor mechanism 8 detects foreign particles or wrinkles on the recording medium, since the feeding of the platen 5 is suspended, or the platen 5 is fed to a direction opposite to the feeding direction at the start of printing, the prevention of foreign particles and wrinkles on the recording medium contacting the nozzle face of the inkjet head 21 can be realized even more easily and inexpensively. Moreover, when printing is performed with the inkjet heat 21, since the clearance sensor mechanism 8 can be withdrawn so as to avoid contacting the recording medium mounted on the platen 5, it is possible to prevent the recording medium and clearance sensor mechanism 8 from becoming damaged or tainted.

Figure 12:
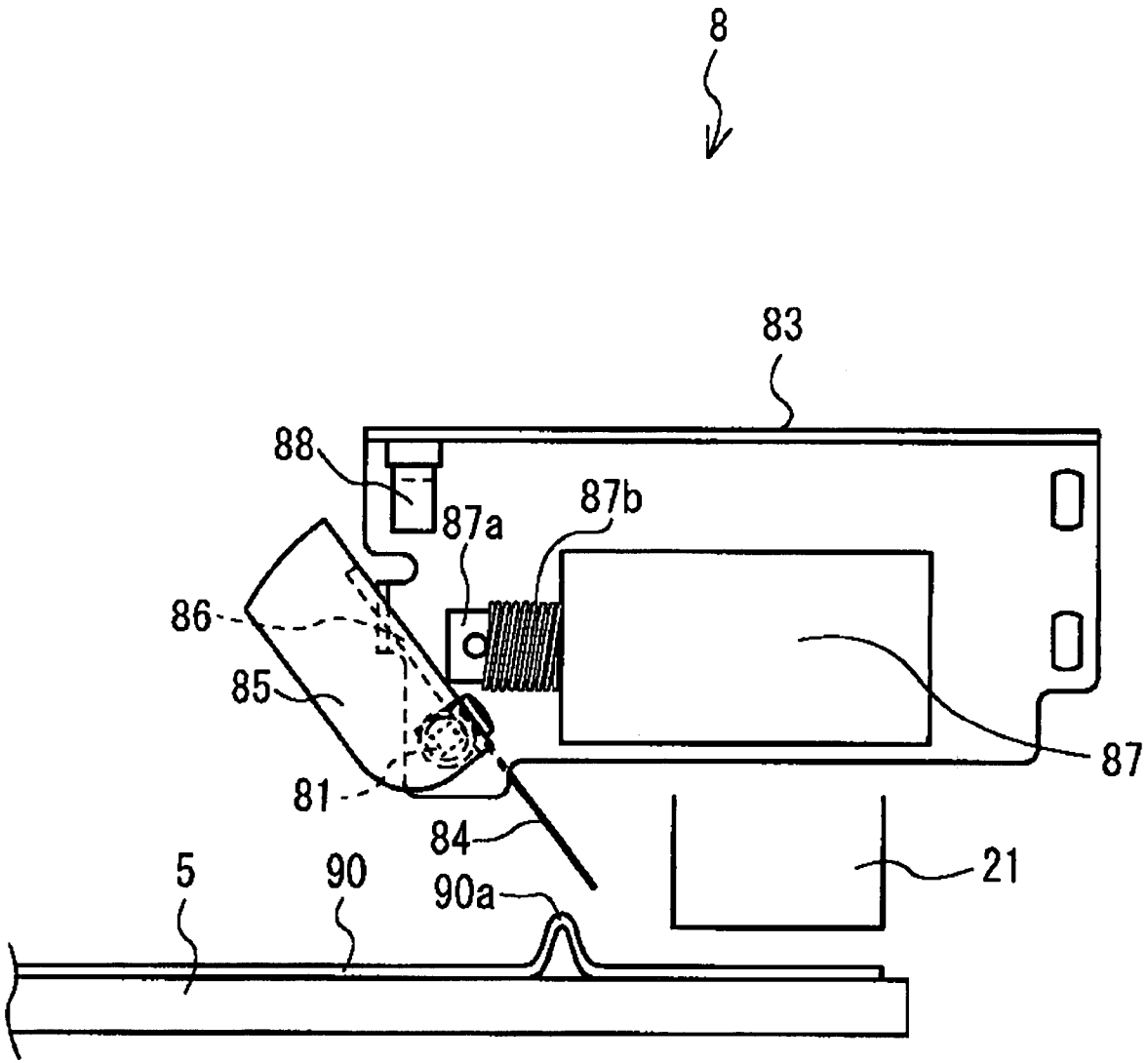
FIG. 12 is a right side schematic view showing the inkjet printer 1 during printing in the second embodiment.

Next, the operation of the inkjet printer 1 according to the second embodiment is explained. The present embodiment is another mode of operation of the inkjet printer 1 (c.f. FIG. 6 to FIG. 8) when an obstacle such as a foreign particle or wrinkle exists in the recording medium mounted on the platen 5 in the first embodiment. FIG. 12 is a right side schematic view showing the inkjet printer 1 during printing in the second embodiment; and FIG. 13 is another right side schematic view showing the inkjet printer 1 during printing in the second embodiment.

In the second embodiment also, as with the first embodiment, when the platen 5 with the T-shirt 90 having a wrinkle 90*a* is fed (c.f. FIG. 6), the portion with the wrinkle 90*a* will contact the plate-like member 84 when it arrives immediately therebelow, and the axis member 81 (plate-like member 84, concealing member 85, receiving member 86) will rotate. Further, as a result of the plate-like member 84 and the wrinkle 90*a* contacting each other, the upper end of the concealing member 85 will move outside the concave portion of the sensor 88, and the sensor 88 will become a non-detection state. Then, the feeding of the platen 5 will be discontinued or be controlled such that the platen 5 is fed to the default position at the front end of the rail 3 (c.f. FIG. 7). Nevertheless, the operation of the clearance sensor mechanism 8 after the occurrence of a contact is different as described below.

As shown in FIG. 12, when the sensor 88 is in a state of not detecting the plate-like member 84, control is made such that the suction operation of the movable member 87*a* by the solenoid 87 is suspended, and the movable member 87*a* is released. As a result, as with FIG. 10, the movable member 87*a* is returned in an extended state to the front direction (forward direction) of the case 2, the movable member 87*a* contacts the rear face of the receiving member 86 that inclined as a result of the contact with the wrinkle 90*a*, and further presses and rotates the receiving member 86 in the front direction (forward direction) of the case 2.

Figure 13:
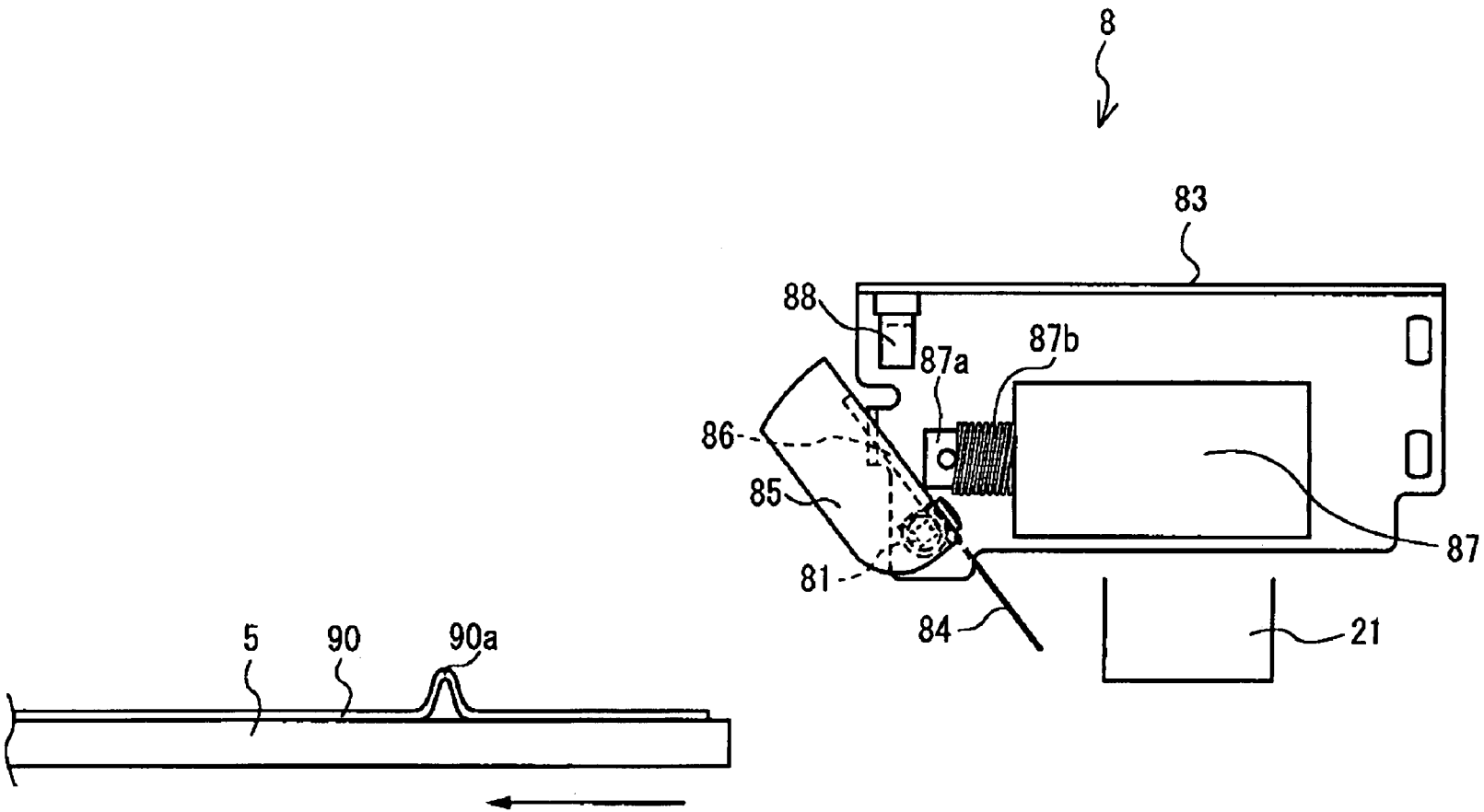
FIG. 13 is another right side schematic view showing the inkjet printer 1 during printing in the second embodiment.

Then, as shown in FIG. 13, the axis member 81 (plate-like member 84, concealing member 85, receiving member 86), in an inclined state, will be supported and fixed with the movable member 87*a* from behind the receiving member 86, and the platen 5 is fed to the default position at the front end of the rail 3. Since the gap between the lower end of the plate-member 84 and the surface of the platen 5 is large, it is possible to prevent the T-shirt 90 mounted on the platen 5 from contacting the plate-member 84.

As described above, when the clearance sensor mechanism 8 detects a foreign particle or wrinkle on the recording medium, the clearance sensor mechanism 8 will rotate so as to broaden the gap with the platen 5. In other words, when a foreign particle or wrinkle is detected on the recording medium and the platen 5 is returned to the default position at the front end of the rail 3, although the portion of the platen 5 that already passed immediately beneath the clearance sensor mechanism 8 will once again pass immediately below the clearance sensor mechanism 8, it is possible to reliably prevent the clearance sensor mechanism 8 from contacting the recording medium mounted on the platen 5.

As described above, according to the inkjet printer 1 of the second embodiment, since the clearance sensor mechanism 8 is made to withdraw so as to avoid contacting the recording medium mounted on the platen 5 when the clearance sensor mechanism 8 detects a foreign particle or wrinkle on the recording medium, it is possible to prevent the recording medium and the clearance sensor mechanism 8 from becoming damaged or tainted.

Figure 14:
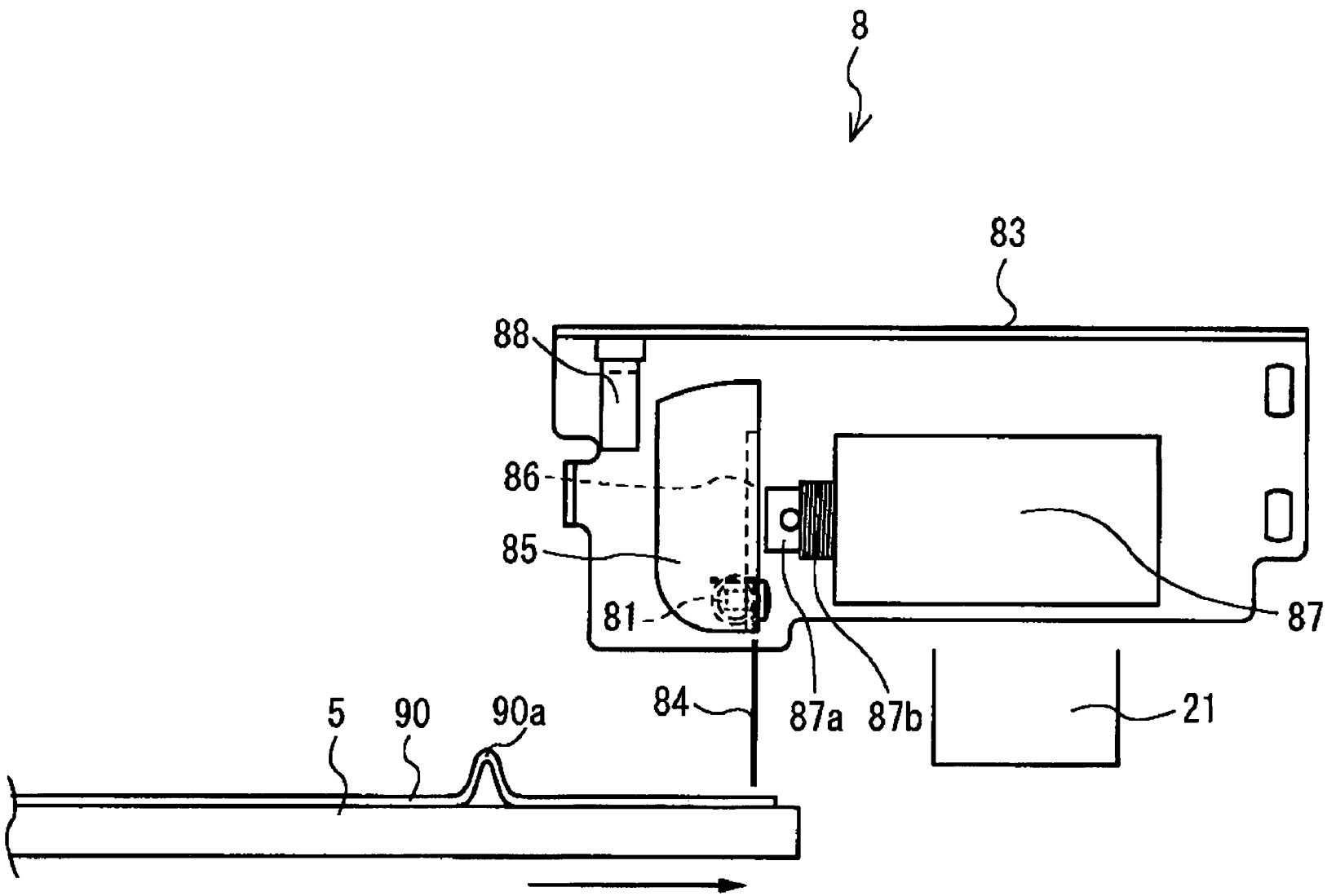
FIG. 14 is a right side schematic view showing the inkjet printer 1 during printing in the third embodiment.
Figure 15:
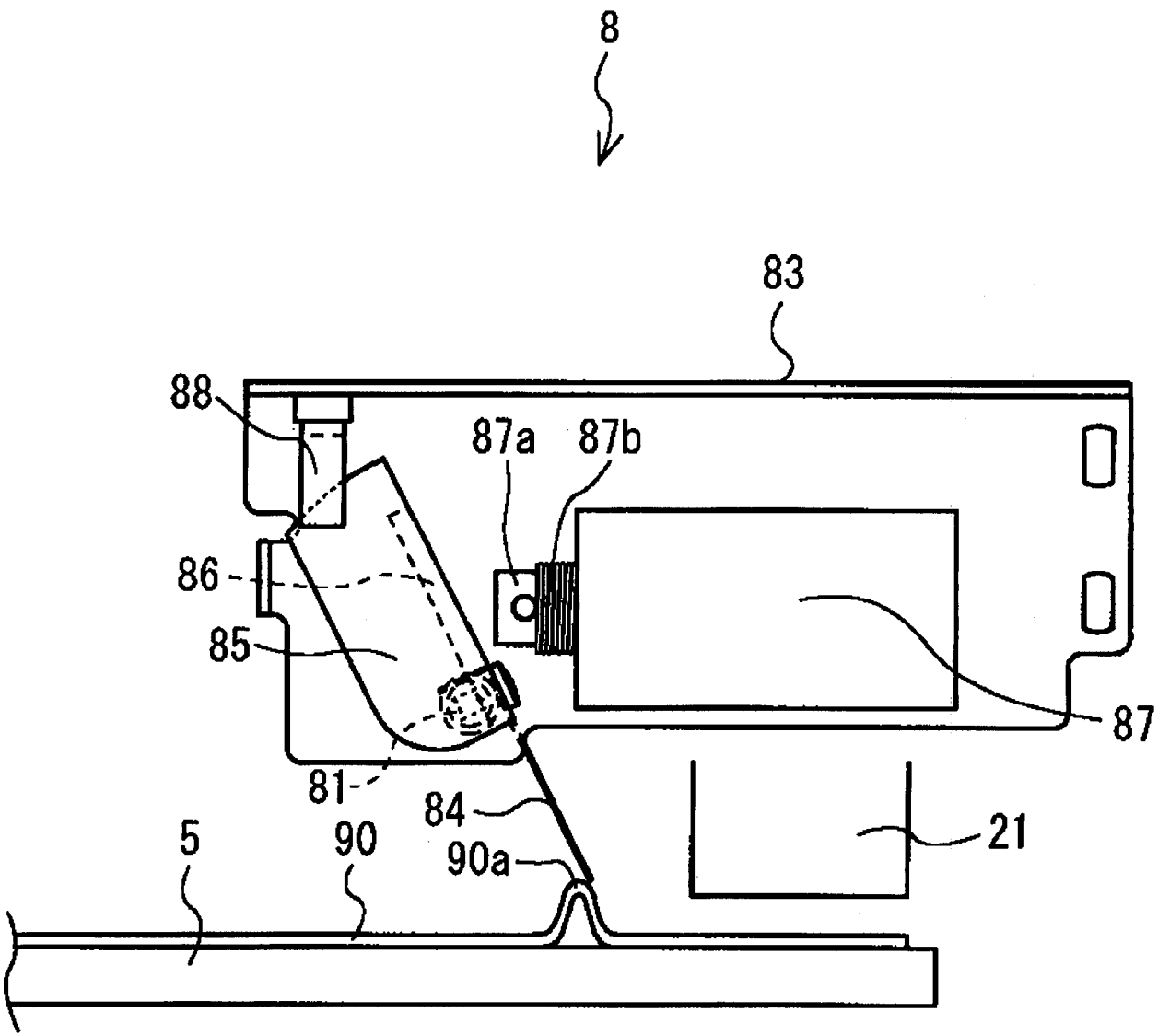
FIG. 15 is another right side schematic view showing the inkjet printer 1 during printing in the third embodiment.

Next, the operation of the inkjet printer according to the third embodiment is explained. This embodiment is another mode of the sensor 88 in the first and second embodiments. FIG. 14 is a right side schematic view showing the inkjet printer 1 during printing in the third embodiment; FIG. 15 is another right side schematic view showing the inkjet printer 1 during printing in the third embodiment; and FIG. 16 is another right side schematic view showing the inkjet printer 1 during printing in the third embodiment.

As shown in FIG. 14, the sensor 88 of the present embodiment is provided to the base unit 83 at a position that is more forward of the case 2 in comparison to the first and second embodiments, and the concave portion of the sensor 88 is longer in the vertical direction. Further, unlike the first and second embodiments, the upper part of an approximately rectangular face of the concealing member 85 is not fitted into the concave portion of the sensor 88, and the sensor light to be propagated between the side faces inside the concave portion is in a conductive state.

In this kind of constitution, the platen 5 with the T-shirt 90 having a wrinkle 90*a* mounted thereon is fed, and, as shown in FIG. 15, the portion with the wrinkle 90*a* contacts the plate-like member 84 when it passes immediately therebelow, and the axis member 81 (plate-like member 84, concealing member 85, receiving member 86) will rotate. Further, as a result of the plate-like member 84 and the wrinkle 90*a* contacting each other, the upper end of the concealing member 85 will move inside the concave portion of the sensor 88, block (conceal) the sensor light inside the concave portion, and the sensor 88 will become a state of not detecting the concealing member 85. Then, as with FIG. 8, the platen 5 is fed to the direction opposite the feeding direction, and returned to the default position before the start of printing.

Figure 16:
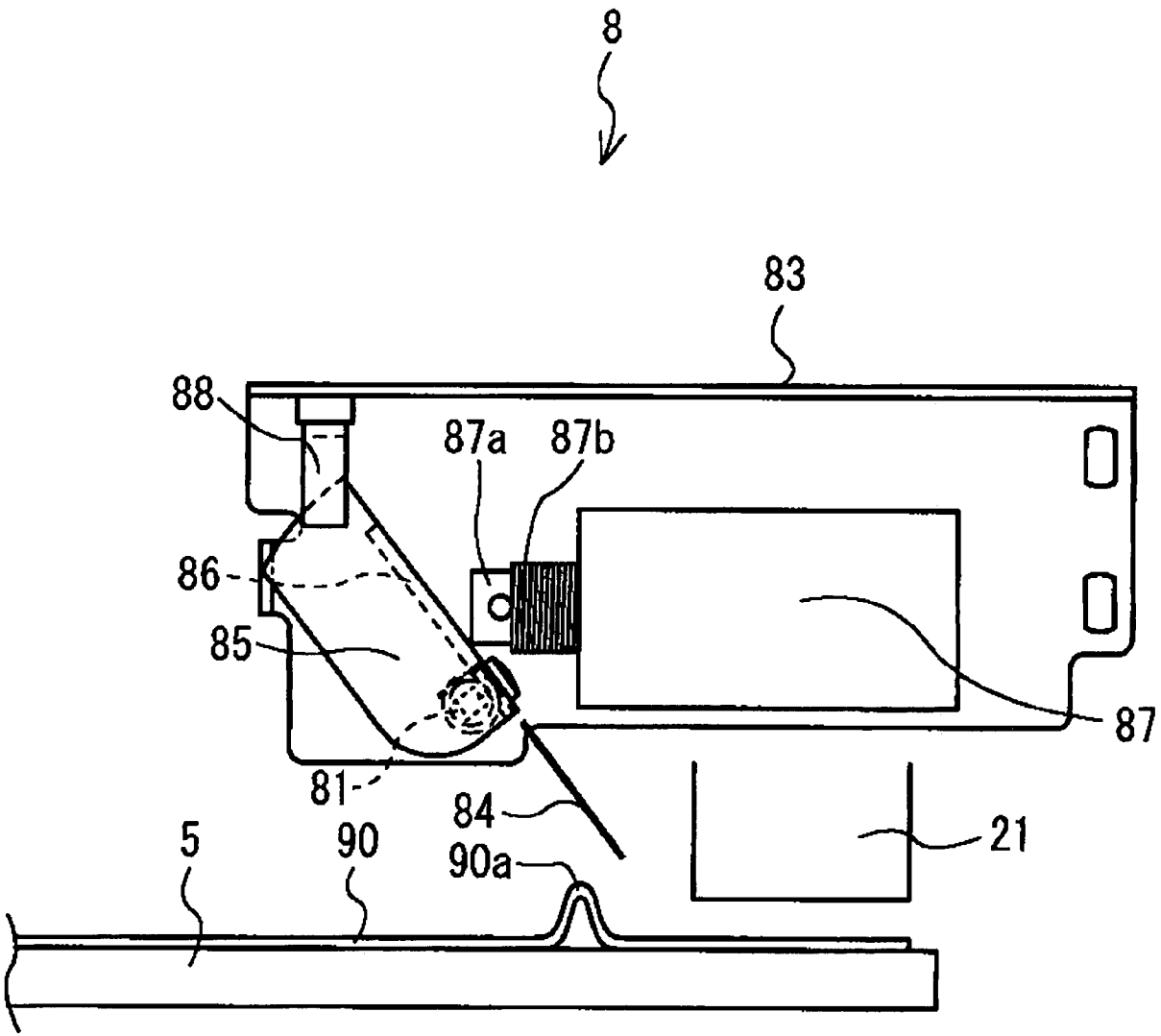
FIG. 16 is another right side schematic view showing the inkjet printer 1 during printing in the third embodiment.

Incidentally, when the sensor 88 is in a state of not detecting the concealing member 85, as shown in FIG. 16, control may be made such that the suction operation of the movable member 87*a* by the solenoid 87 will be suspended, and the movable member 87*a* may be released. Then, as with FIG. 13, the axis member 81 (plate-like member 84, concealing member 85, receiving member 86), in an inclined state, will be supported and fixed with the movable member 87*a* from behind the receiving member 86, and the platen 5 will be fed to the default position at the front end of the rail 3.

As described above, when the sensor 88 enters a state of not detecting the concealing member 85 in the first and second embodiments, the feeding of the platen 5 is suspended, or controlled such that the platen 5 is fed to the default position at the front end of the rail 3. Meanwhile, according to the inkjet printer 1 of the third embodiment, when the sensor 88 enters a state of detecting the concealing member 85, the feeding of the platen 5 is suspended, or controlled such that the platen 5 is fed to the default position at the front end of the rail 3.

Incidentally, in the foregoing first to third embodiments, the inkjet head 21 corresponds to the "recording unit" of the present invention, the platen drive motor 7 corresponds to the "feed mechanism" of the present invention, the clearance sensor mechanism 8 corresponds to the "detection unit", and the solenoid 87 corresponds to the "detection unit withdrawal unit" and "actuator" of the present invention.

In addition, the present invention is not limited to the foregoing first to third embodiments, and various modifications thereof are possible as a matter of course.

With the inkjet printer 1 in the foregoing embodiments, upon starting printing, the platen 5 standing by at the default position is fed toward the rear end of the rail 3. Thereafter, upon performing printing, the feeding direction of the platen 5 is reversed, and the platen 5 is fed along the rail 3 from the rear end of the rail 3 toward the front end thereof. During this course, when the platen 5 reaches the printing performing position to be scanned by the inkjet head 21, the inkjet head 21 performs printing to the recording medium. Nevertheless, the present invention can also be employed in a printing-type inkjet recording device in which recording is performed to the recording medium when the platen 5 reaches the printing performing position to be scanned by the inkjet head 21 during the course of the platen 5 being fed from the default position to the rear end of the rail 3.

Further, the present invention may be employed so as long as it is an inkjet recording device in which recording is performed while a platen having mounted thereon a recording medium is fed. As with the foregoing embodiments, without restriction to a serial printer which scans the recording head and prints one character or one dot at a time, for instance, the present invention may also be employed in a line printer which prints one line at a time with a fixed recording head.

In addition, control of the respective mechanisms constituting the inkjet recording device is possible in various modes. In the foregoing embodiments, when the inkjet head 21 starts printing, the suction operation of the movable member 87*a* by the solenoid 87 is suspended. Nevertheless, it would suffice so as long as the solenoid 87 operates and withdraws the plate-like member 84 at least before the platen 5 having mounted thereon the recording medium after the recording has been performed is fed immediately beneath the plate-like member 84. Thus, for instance, when the platen 5 being fed upon starting printing finishes passing through immediately below the plate-like member 84, this can be deemed that no obstacles such as foreign particles or wrinkles could be detected from the recording medium. Thus, even if the inkjet head 21 has not started printing, control may be made such that the solenoid 87 may operate to withdraw the plate-member 84. Incidentally, since the control of the respective mechanisms is realized with the various control programs stored in the ROM 120, the user or designer may add or change these control programs to realize the arbitrary control of such mechanisms.

Moreover, in the above-mentioned embodiments, although the solenoid 87 is uses as the actuator for pressing the receiving member 86 and rotating the clearance sensor mechanism 8, other actuators such as a hydraulic motor or a pneumatic cylinder may also be used.

Further, in the foregoing embodiments, although the sensor 88 is an optical sensor and the concealing member 85 is used to turn the sensor light ON/OFF for conducting such detection, a magnetic sensor of contact sensor may be employed to detect the position of the concealing member 85 to determine the ON/OFF.

The inkjet recording device of the present invention can be applied to an inkjet-type recording device which performs recording by the platen having mounted thereon a recording medium being fed.

The entire disclosure of the specification, claims, summary and drawings of Japanese Patent Application No. 2004-6996 filed on Jan. 14, 2004 is hereby incorporated by reference.

What is claimed is:

1. An inkjet recording device comprising:

a recording unit equipped with a nozzle face for performing recording by ejecting ink to a recording medium;

a platen disposed facing said nozzle face for supporting said recording medium at a prescribed spacing from said nozzle face;

a feed mechanism for feeding said platen to a position where recording is to be performed with said recording unit, in which said recording unit records on said recording medium while said feed mechanism feeds said platen, and, after the recording is completed, said feed mechanism feeds said platen to a standby position of said platen prior to the start of recording;

a detection unit configured to face said platen between said standby position and said recording unit, and for detecting an obstacle on said recording medium supported by said platen at a detection position between said platen and said nozzle face;

a feed mechanism control unit for controlling said feed mechanism to stop feeding said platen or to feed said platen to said standby position when said detection unit detects said obstacle; and a detection unit withdrawal unit for withdrawing said detection unit to a position at which said detection unit avoids said recording medium after the recording is completed;

wherein the detection unit has a plate-like member configured to contact said obstacle, the plate-like member having a width greater than a width of the platen.

2. An inkjet recording device according to claim 1, wherein said detection unit withdrawal unit withdraws said detection unit to a position at which said detection unit is at least 5 mm apart from said recording medium after the recording is completed.

3. An inkjet recording device according to claim 2, wherein said detection unit withdrawal unit withdraws said detection unit to a non-detecting position at which said detection unit is located higher than said nozzle face with respect to said platen during a period of time when said detection unit does not perform detection or when said recording unit performs recording.

4. An inkjet recording device according to claim 1, wherein said detection unit withdrawal unit withdraws said detection unit to a non-detecting position at which said detection unit is located higher than said nozzle face with respect to said platen during a period of time when said detection unit does not perform detection or when said recording unit performs recording.

5. An inkjet recording device according to claim 1, wherein said detection unit is supported rotatably about an axis line orthogonal to a direction in which said platen is fed, has a concealing member provided integrally with said plate-like member for determining whether or not said obstacle was detected, and a sensor unit for detecting said concealing member, wherein, when said obstacle contacts said plate-like member while said platen is being fed, said concealing member rotates about said axis line; and when said sensor unit transits from a detection state to a non-detection state or transits from a non-detection state to a detection state for said concealing member, said feed mechanism control unit controls said feed mechanism to stop feeding said platen or to feed said platen to said standby position.

6. An inkjet recording device according to claim 5, further comprising a detection unit withdrawal unit that rotates and withdraws said plate-like member.

7. An inkjet recording device according to claim 6, wherein said detection unit withdrawal unit is an actuator which is provided in the vicinity of said detection unit and which presses and rotates said plate-like member.

8. An inkjet recording device according to claim 1, wherein said recording medium is fabric.

9. An inkjet recording device comprising:

a recording unit equipped with a nozzle face for performing recording by ejecting ink to a recording medium;

a platen disposed facing said nozzle face for supporting said recording medium at a prescribed spacing from said nozzle face;

a feed mechanism for feeding said platen to a recording position where recording is to be performed with said recording unit, in which said recording unit records on said recording medium while said feed mechanism feeds said platen, and, after the recording is completed, said feed mechanism feeds said platen to a standby position of said platen;

a detection unit for detecting an obstacle on said recording medium supported by said platen contacts said nozzle face, when said platen moves to the recording position from the standby position; and a feed mechanism control unit for controlling said feed mechanism to stop feeding said platen or to feed said platen to said standby position when said detection unit detects said obstacle; and a detection unit withdrawal unit for withdrawing said detection unit to a position at which said detection unit avoids said recording medium during an ink-ejecting operation after the platen has been moved to the recording position, ink being ejected to the recording medium during the ink-ejecting operation.

10. An inkjet recording device according to claim 9, wherein said detection unit withdrawal unit withdraws said detection unit to a position at which said detection unit is at least 5 mm apart from said recording medium after the recording is completed.

11. An inkjet recording device according to claim 9, wherein said detection unit withdrawal unit withdraws said detection unit during a period of time when said detection unit does not perform detection or when said recording unit performs recording.

12. An inkjet recording device according to claim 9, wherein said detection unit withdrawal unit withdraws said detection unit to a non-detecting position at which said detection unit is placed higher than said nozzle face with respect to said platen.

13. An inkjet recording device comprising:

a recording unit equipped with a nozzle face for performing recording by ejecting ink to a recording medium;

a platen disposed facing said nozzle face for supporting said recording medium at a prescribed spacing from said nozzle face;

a feed mechanism for feeding said platen to a position where recording is to be performed with said recording unit, in which said recording unit records on said recording medium while said feed mechanism feeds said platen, and, after the recording is completed, said feed mechanism feeds said platen to a standby position of said platen prior to the start of recording;

a detection unit configured to face said platen between said standby position and said recording unit, and for detecting an obstacle on the recording medium;

a feed mechanism control unit for controlling said feed mechanism to stop feeding said platen or to feed said platen to said standby position when said detection unit detects the obstacle; and a detection unit withdrawal unit for withdrawing said detection unit to a position at which said detection unit avoids said recording medium after the recording is completed;

wherein the detection unit has a plate-like member configured to contact the obstacle, the plate-like member having a width greater than a width of the platen.

14. An inkjet recording device comprising:

a recording unit equipped with a nozzle face for performing recording by ejecting ink to a recording medium;

a platen disposed facing said nozzle face for supporting said recording medium at a prescribed spacing from said nozzle face;

a feed mechanism for feeding said platen to a position where recording is to be performed with said recording unit, in which said recording unit records on said recording medium while said feed mechanism feeds said platen, and, after the recording is completed, said feed mechanism feeds said platen to a standby position of said platen prior to the start of recording;

a detection unit for detecting an obstacle on the recording medium; and a feed mechanism control unit for controlling said feed mechanism to stop feeding said platen or to feed said platen to said standby position when said detection unit detects the obstacle; and a detection unit withdrawal unit for withdrawing said detection unit to a non-detecting position at which said detection unit avoids said recording medium during an ink-ejecting operation after the platen has been moved to the recording position.

* * * * *